US008776710B2

(12) United States Patent
Gayton

(10) Patent No.: US 8,776,710 B2
(45) **Date of Patent: *Jul. 15, 2014**

(54) WATERCRAFT IMMOBILIZING APPARATUS AND SYSTEM

(75) Inventor: Richard J. A. Gayton, Phillipsburg, NJ (US)

(73) Assignee: Richard A. Gayton, Phillipsburg, NJ (US)

( * ) Notice: Subject to any disclaimer, the term of this patent is extended or adjusted under 35 U.S.C. 154(b) by 46 days.

This patent is subject to a terminal disclaimer.

(21) Appl. No.: 13/305,309

(22) Filed: Nov. 28, 2011

(65) Prior Publication Data

US 2012/0103241 A1 May 3, 2012

Related U.S. Application Data

(63) Continuation-in-part of application No. PCT/US2010/001499, filed on May 20, 2010, and a continuation-in-part of application No. 12/473,659, filed on May 28, 2009, now Pat. No. 8,176,867.

(51) Int. Cl.
*B63G 9/00* (2006.01)

(52) U.S. Cl.
USPC ..... 114/240 D; 114/253; 114/254

(58) Field of Classification Search
USPC ..... 114/240 C, 240 D, 240 E, 240 R, 241, 114/243, 245, 247, 253, 254, 382; 43/4.5
See application file for complete search history.

(56) References Cited

U.S. PATENT DOCUMENTS

| | | | |
|---|---|---|---|
| 885,412 | A | 4/1908 | Williams |
| 1,204,547 | A | 11/1916 | Corrado et al. |
| 1,223,536 | A | 4/1917 | Travelstead |
| 1,247,686 | A | 11/1917 | Jackson, Jr. |
| 1,256,346 | A | 2/1918 | Mattson |
| 1,271,415 | A | 7/1918 | Bacon |
| 1,274,299 | A | 7/1918 | McGowan |
| 1,280,525 | A | 10/1918 | Nittner |
| 1,298,325 | A | 3/1919 | Garaca |
| 1,328,549 | A | 1/1920 | Thompson |
| 1,330,729 | A | 2/1920 | Starr |
| 1,333,224 | A | 3/1920 | Sperry |
| 1,772,888 | A | 8/1930 | Ella |

(Continued)

FOREIGN PATENT DOCUMENTS

| | | | |
|---|---|---|---|
| DE | 10122254 | A1 | 11/2002 |
| FR | 2557568 | A1 | 7/1985 |

(Continued)

OTHER PUBLICATIONS

Counter Piracy Net by APMSS—Advertisement on http://www.apmss.co.uk.

(Continued)

*Primary Examiner* — Lars A Olson

(74) *Attorney, Agent, or Firm* — Kramer Levin Naftalis & Frankel LLP

(57) ABSTRACT

A watercraft immobilizing apparatus and system for a marine vessel to passively defend against an attacking engine-powered watercraft includes a towed array of entanglement lines. The entanglement lines can be provided on and administered from removable/replaceable storage cartridges mountable on and/or deployed via davits, outriggers, paravanes, and/or weighted submersible rollers to foul and immobilize propellers and engine cooling water intakes of encroaching watercraft.

40 Claims, 22 Drawing Sheets

(56) References Cited

U.S. PATENT DOCUMENTS

| | | | | |
|---|---|---|---|---|
| 2,313,664 | A | 3/1943 | Mount | |
| 2,383,095 | A | 8/1945 | Wallace | |
| 2,386,950 | A | 10/1945 | Hopkins | |
| 2,395,056 | A | 2/1946 | Luby | |
| 2,668,512 | A | 2/1954 | Klas | |
| 2,967,505 | A | 1/1961 | Klas | |
| 2,967,506 | A * | 1/1961 | Livermore | 114/240 R |
| 3,687,418 | A | 8/1972 | Halvorsen | |
| 3,943,644 | A | 3/1976 | Walz | |
| 4,729,333 | A | 3/1988 | Kirby et al. | |
| 5,069,109 | A | 12/1991 | Lavan, Jr. | |
| 5,913,670 | A * | 6/1999 | Anderson et al. | 43/4.5 |
| 6,325,015 | B1 | 12/2001 | Garcia et al. | |
| 6,359,833 | B1 | 3/2002 | English | |
| 6,591,774 | B2 | 7/2003 | Metherell et al. | |
| 7,092,315 | B2 | 8/2006 | Olivier | |
| 7,509,769 | B2 | 3/2009 | Wilcox et al. | |
| 8,667,917 | B2 * | 3/2014 | Brewer | 114/14 |
| 2001/0032577 | A1 | 10/2001 | Swartout et al. | |
| 2004/0194688 | A1 | 10/2004 | Metherell | |
| 2007/0017432 | A1 | 1/2007 | Farinella et al. | |
| 2009/0038530 | A1 | 2/2009 | Truong et al. | |
| 2009/0084284 | A1 | 4/2009 | Martinez et al. | |

FOREIGN PATENT DOCUMENTS

| | | | |
|---|---|---|---|
| GB | 2 371 024 | | 7/2002 |
| WO | WO 99/30966 | | 6/1999 |
| WO | WO/03/085207 | A2 | 10/2003 |
| WO | WO 2004/075132 | | 2/2004 |
| WO | PCT/US2004/014132 | | 5/2004 |
| WO | WO/2005/113371 | A1 | 1/2005 |
| WO | WO 2005/113330 | | 12/2005 |
| WO | WO 2006/083429 | | 8/2006 |
| WO | WO 2007/081292 | | 7/2007 |
| WO | WO 2007/100835 | | 9/2007 |
| WO | WO 2008/100278 | | 8/2008 |
| WO | WO 2009/020602 | | 2/2009 |

OTHER PUBLICATIONS

"Non-Lethal Ballistic Net System Stops Small Boats", www.entrepreneur.com, PRNewswire, Apr. 15, 2009.

"Pneumatic Net Thrower for Ships (anti-piracy) Sea Scorpion Systems LVI", www.seascorpion.co.uk.

www.p-trp.eu, 2010.

Merchant Maritime Warfare Centre, MMWC Propeller Arresters Stop Unlawful Boarding of Vessels Without Force, The Journal of Commerce Online—Press Release, Mar. 17, 2010.

Excerpt from a 1930's navy seaman's manual.

* cited by examiner

WATERCRAFT IMMOBILIZING APPARATUS AND SYSTEM

CROSS REFERENCE TO RELATED APPLICATIONS

This application is a continuation-in-part of co-pending International Application No. PCT/US2010/001499, designating the United States, with an international filing date of May 20, 2010, and claims the benefit of U.S. patent application Ser. No. 12/473,659 filed on May 28, 2009, the disclosures of which are incorporated herein by reference in their entireties.

FIELD OF INVENTION

The present invention generally relates to a passive, non-lethal marine vessel defense apparatus and system that can immobilize attacking watercraft.

BACKGROUND OF INVENTION

Maritime piracy (as well as acts of terrorism) targeting both commercial and non-commercial vessels has become increasingly prevalent in recent years. According to available data, there were approximately 400 reported pirate attacks globally in 2009, out of which about 150 vessels were boarded, over 50 vessels were hijacked, and over 100 vessels were fired upon; also, over 1,000 crew members were taken hostage with about 70 being injured and around 10 confirmed deaths. The comparative numbers for 2008 show about 300 reported incidents and about 40 vessels hijacked. The Gulf of Aden, a hot bed of piracy, was the site of about 120 attacks. Somali pirates have been identified as being responsible for over 200 acts of piracy in 2009, and their reach now extends more than 1,000 miles from the coast of Somalia. The percentage of successful hijackings in the Indian Ocean was about 25% of the vessels attacked through the last quarter of 2009. The over 50 successful hijackings in 2009 resulted in approximately $177 million in total ransoms paid to Somali pirates. In 2010, although there were fewer hijackings (about 44), total ransoms paid were higher, at about $238 million. The attacks continue to increase as have the average quantum of the ransoms paid.

Pirates have proven that the use of high speed conventionally powered small watercraft is highly effective and very difficult to deter. Prior experience in the Gulf of Aden has shown that successful attacks are typically conducted during twilight hours, from astern of and on the port quarter of the targeted vessel. The increased military presence in the Gulf of Aden has effectively forced Somali pirates to extend and venture further out into the Indian Ocean where potential targets are afforded less protection. They have managed to do this by utilizing hijacked vessels as mother ships. This has enabled pirates to attack vessels up to 1000 miles off the coast of Somalia. Pirates usually favor vessels that are alone, slow moving and loaded, hence with low freeboards.

It is the general policy of insurance companies to pay the very high ransoms demanded for hijacked international flag vessels, cargoes and crews. Indeed, the surge in activity off the east coast of Somalia has, as noted above, led to ransom payments in excess of $200M for this region alone. The total cost of piracy has recently been reported to be about $12 to 15 billion annually. Insurance companies have increased tenfold surcharges for sending a cargo shipment through the Gulf of Aden (according to Lloyds List, approximately 20,000 vessels transited the Gulf of Aden in 2009 alone). Single trip policies through the Gulf of Aden with a $3 million ransom clause, can cost around $30,000, with additional premiums for crew liability. The hike in insurance rates has caused many ship operators to plot routes south of Africa and the Cape of Good Hope, however this is not always cost effective when carrying time sensitive cargo. Lloyd's estimates the average increase in cost to sail this southerly route to be about $80,000 per trip.

The current deterrents being utilized generally favor the use of armed guards/escorts or other lethal force. However, international authorities have been reluctant to recommend such danger prone and potentially lethal methods. Also, the cost of hiring a security escort to pass through the Gulf of Aden/Suez Canal can be as much as $100,000, depending on the ship's size and the value of its cargo. The costs associated with deployment of armed guards are increasing relative to the ever expanding need for protection. The further drawback of this type of protection is that the vessel is only protected while the guards are embarked. Armed resistance also triggers many other concerns.

Therefore, there is an urgent need for a primary, stand-alone, passive, non-lethal and cost-effective marine vessel defense apparatus and system that can be deployed by the vessel's own crew to immobilize an attacking watercraft (whether detected or undetected) before it can reach the vessel.

SUMMARY OF THE INVENTION

Generally speaking, the present invention is directed to embodiments of a new, non-lethal watercraft immobilizing apparatus and system that can be deployed from any marine vessel to defend against attacking engine powered watercraft. Improving over conventional net-deploying systems, embodiments of the present invention include a towed array of wires, SPECTRA lines, polymer or nylon lines ("tendril lines" or "lines") at or below the water surface, which may be weighted for neutral buoyancy. The towed array of tendril lines can foul and immobilize propellers and engine cooling water intakes of attacking watercraft (whether or not detected). An arrangement of secondary and possibly tertiary tendril lines can also be deployed from the primary lines.

The towed lines can be deployed from removable/replaceable cartridges (that can be disposed of after use or refurbished). The cartridges can be mounted on supports or outriggers positioned strategically about the assailable faces of the vessel.

Banks of suspended, weighted, submersible dual rollers can be included to direct the tendril lines fed from the cartridges, which can be deployed and recovered manually or automatically by means of motors, for example. Each bank of rollers can feature secondary winches or davits at the extremities that can also be operated by motor. The winches or davits can hold the wire/line that deploys the weighted submersible dual rollers for each bank. The weighted dual rollers can be configured to place the towed array at or below the water surface adjacent to the cartridges.

A main bank of rollers can be mounted off the vessel's transom (e.g., suspended not from outriggers but from the vessel's existing aft structures, such as, for example, the aft bulwark). Two transom outriggers (e.g., one at each extremity of the vessel), can each be configured to deploy its own bank of rollers. The weighted submersible dual rollers in the way of these two aft outriggers can be configured to be connectable to the extremities of the rollers of the main transom bank, effectively forming one unit. Deep fins can be situated at the outer extremities of these rollers to prevent the lines of the towed side arrays from fouling the vessel's own propeller(s).

Additional outriggers can each be configured to deploy its own bank of rollers at the vessel's forward shoulders (e.g., on port and starboard sides). These banks can be similarly fitted with powered submersible dual rollers to effectively deploy side arrays to shield the vessel's sides. Each cartridge can administer multiple main lines and/or an array of tendril lines through the adjacent submersible roller(s). The ends of each of the main lines for each cartridge can be held in a submerged pattern by weighted spreader bars, which can be finned for improved stability.

Alternatively, or in addition, two or more davits/outriggers (e.g., one at each extremity of the vessel at a forward position such as the focsle of the vessel, and/or one at each extremity of the vessel at an aft position such as the transom of the vessel) can be configured to deploy one or more drogues/foils/rudders (e.g., deep-finned, floated, and buoyant), which can be similar to paravanes, (hereinafter, "paravanes"). The paravanes can be interconnected by a transverse submersible wire/chain that can support rollers. The paravanes can be towed from wires streamed from forward positions to prevent the paravanes and transverse submersible wire or chain from trailing aft of the transom. For example, in some embodiments, each paravane can be towed by one or more wire, chain or SPECTRA booms (hereinafter, "floated booms"), which can be held in position from the vessel's stem by a traveling block, folding bowsprit, or hard connection to the hull of the vessel. Thus, each paravane and respective floated boom(s) can mutually hold each other in position. The side array of tendril lines can then be streamed from one or more of the floated booms. In some embodiments, when utilizing the optional hard connection to the hull of the vessel (e.g., port and/or starboard bow), the floated boom can be stored in a bight from the head of the foremast, which can provide protection that is simple and cost effective. Tendril lines of the main stern bank can then be fed through links of the interconnecting submersible wire/chain (or rollers supported by the interconnected wire/chain), which can hold the tendril lines in/on the water below (e.g., immediately below) the transom.

Alternatively, or in addition, banks of storage rollers can be provided at the vessel's focsle (e.g., on port and starboard sides). These banks can be similarly powered to feed the tendril lines through floated booms (e.g., on port and starboard sides) to effectively deploy the side arrays and shield the vessel's sides. Each cartridge can be situated on one or more of the self-tensioning winches and can administer multiple main lines and/or an array of tendril lines through the adjacent floated booms. The ends of each of the main lines for each cartridge can be held in a submerged pattern by finned floats and/or spreader bars, which can also be finned for improved stability.

In some embodiments, the paravanes can be configured to prevent the possibility of the lines of the towed side arrays from fouling the vessel's own propeller(s). The paravanes can be deep-finned, situated at or just below the sea or water surface (e.g., approximately 20 to 30 degrees abaft of the stem on both the port and starboard sides of the vessel). The floated booms can be fitted with eyes or rollers (which can include storage rollers) positioned at suitable intervals through which the tendril lines can be fed. The floated booms can feed the lines into the water forward of the storage positions of the lines.

The floated booms, paravanes and tendril lines can be deployed and/or recovered by separate winches or davits. It should be appreciated that the floated boom and paravane assembly deployed from the stem of the vessel can dramatically increase the area of protection along the vessel's sides and can also provide protection of the bow of the vessel.

The watercraft immobilizing apparatus and system according to embodiments of the present invention can be deployed remotely (e.g., from the vessel's bridge), and as quickly as the vessel's own speed through the water. The vessel does not have to reduce speed for deployment or recovery.

It is therefore an object of the present invention to provide a passive, non-lethal, easy-to-use, cost-effective defensive shield around a marine vessel to immobilize and thus repel attacking watercraft (whether or not such watercraft have been detected).

Still other objects and advantages of the invention will in part be obvious and will in part be apparent from the specification.

The present invention accordingly comprises the features of construction, combination of elements, and arrangement of parts that will be exemplified in the constructions hereinafter set forth, and the scope of the invention will be indicated in the claims.

BRIEF DESCRIPTION OF THE DRAWINGS

For a fuller understanding of the present invention, reference is had to the following description taken in connection with the accompanying drawings in which.

DETAILED DESCRIPTION OF THE PREFERRED EMBODIMENTS

Figure 1A:
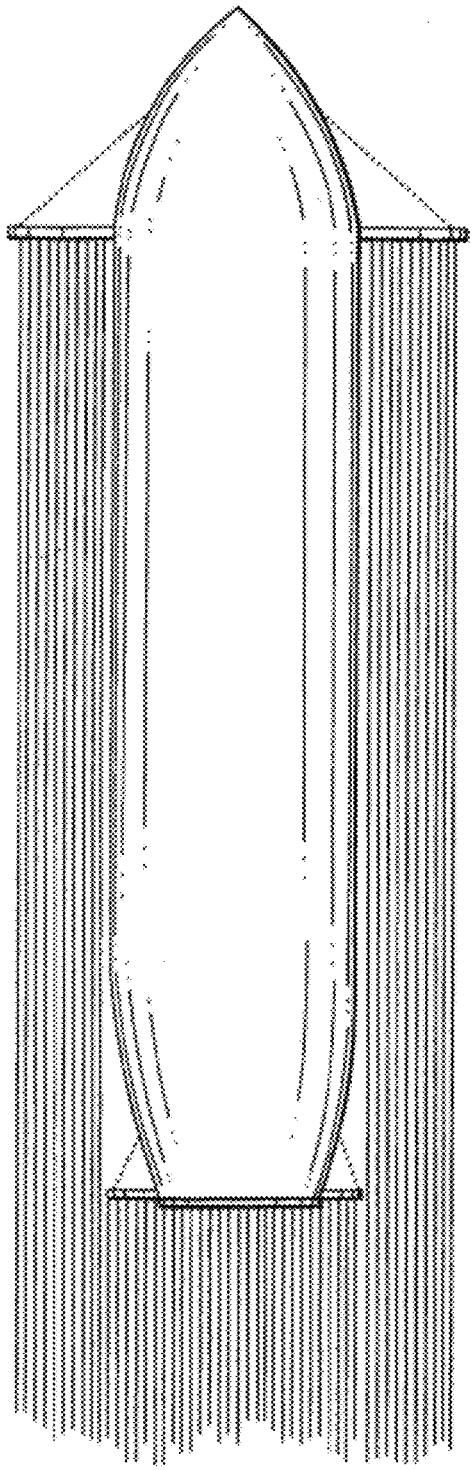
FIG. 1*a* is a simplified plan view of a marine vessel deploying a watercraft immobilizing apparatus and system in accordance with embodiments of the present invention, illustrating exemplary positioning of a main transom bank of submersible rollers and tendril lines, aft outrigger banks, forward shoulder outrigger banks, and forward outrigger stays.

In accordance with embodiments of the present invention, a passive, non-lethal marine vessel piracy defense apparatus and system are provided that can be deployed about the assailable faces of the vessel to repel attacking watercraft by fouling and thus immobilizing their propellers and engine intakes. Generally speaking, this is accomplished by a towed (at or below the water surface) array of entanglement tendril lines.

Marine engines are designed to propel a craft by moving water in various ways, for example through open or enclosed propellers, through jet engines and through cooling systems. It will be appreciated that the towed array according to embodiments of the present invention moves with this water into the attacking vessel's propellers, cooling intakes or jet intakes, hence fouling and stopping the engine(s).

It will also be appreciated that the towed array according to embodiments of the present invention provides a defense against piracy that can be characterized as "passive" because the array remains deployed throughout a voyage without unduly interfering with vessel operations. Moreover, when in a deployed state, attacking watercraft need not be detected in order to repel an attack.

The towed tendril lines can be engineered to break free when the mass of an entangled attacking watercraft is exerted on the towed array, hence releasing the watercraft adrift. Attacking watercraft can entangle very quickly on relatively few lines.

The tendril lines can be formed from polymer, nylon or SPECTRA lines, or from wires, and can be weighted for neutral buoyancy (e.g., weighted or coated with emulsion). The tendril lines can also advantageously be formed from a biodegradable material. For example, BIOLINE with an active shelf life of six to twelve months, which is purported to be a biodegradable product engineered to protect the environment, can be used. According to its manufacturer, BIOLINE is made from a biodegradable polymer that will completely biodegrade within five years (in its twelve month usable life format); and it can be engineered to biodegrade more rapidly. Regular monofilament or fluorocarbon line takes over six hundred years to biodegrade. Preferably, the lines can have negative buoyancy when cast adrift so that they can sink to the seabed.

An arrangement of secondary and possibly tertiary lines deployed from the primary tendril lines at or just below the water surface can also be provided. These tendril lines can have varying lengths, and can be staggered at intervals of, for example, five feet, along the primary lines.

Furthermore, as described in greater detail hereinafter, the towed array of tendril lines can be deployed via floated wire/chain/SPECTRA booms, which can be positioned by a traveling block, folding bowsprit, floated paravanes, hard connection to the hull of the vessel, outriggers, rollers, and/or spreaders.

The tendril lines can be administered from removable/replaceable (and even disposable or refurbishable) cartridges. Each cartridge can administer multiple main lines and, possibly, an array of sub-tendril lines, through links or eyes of the floated booms, and/or by way of rollers. The ends of each of the main lines for each cartridge can be held in a submerged pattern by finned floats and/or spreader bars (and/or intermediate spreaders), which can be suitably finned and/or weighted to push the tendril lines away from the side of the vessel. This can also improve stability.

Damaged sections of the towed array can be replaced by removing and inserting a new or reconditioned cartridge. Cartridges can include the neutrally weighted multiple main lines, secondary and tertiary lines along with the spreaders.

Where fitted, banks of the rollers can be configured to feature multiple ones of the removable cartridges and can be easily and rapidly deployed/recovered manually (e.g., gravity deployment from a spring tension device) or automatically (including by remote control, by means of electric/hydraulic motors, for example). Each bank can feature secondary winches at the extremities, which can also be operated manually or remotely by electric/hydraulic motor. These winches can store the line/wire that deploys (suspends) weighted submersible dual rollers for each bank.

The weighted dual rollers can be used to place and hold the towed array below the water surface beneath the cartridges. These dual rollers can be further secured below the deployment banks to prevent the rollers from riding aft and above the water surface by preventer wires led from the extremities of the rollers to a strong point on deck forward of the roller installation.

A main bank of rollers can feature multiple removable cartridges and can be mounted off the vessel's transom. Additionally, two transom outriggers, one at each extremity, can deploy further banks of rollers also featuring multiple removable cartridges. The weighted submersible dual rollers in the way of these aft outriggers can be connected to the extremities of the weighted submersible dual rollers of the main transom bank, effectively forming one unit. Deep fins can be provided at the outer extremities of these rollers to prevent the possibility of the lines of the towed side arrays fouling the vessel's own propeller(s). Additional outriggers, which can be deployed at other locations to shield the vessel, can deploy rollers that also feature multiple cartridges. These banks can be similarly fitted with submersible dual rollers. The towed side arrays can also be fitted with independent spreaders appropriately finned.

Each storage bank of rollers can deploy a suitable amount (length) of towed tendril lines supporting multiple sub-tendril lines in a varying pattern to give practical full, all-round protection and to maximize the arresting affect of an attacking watercraft's propeller or intake system.

Figure 1B:
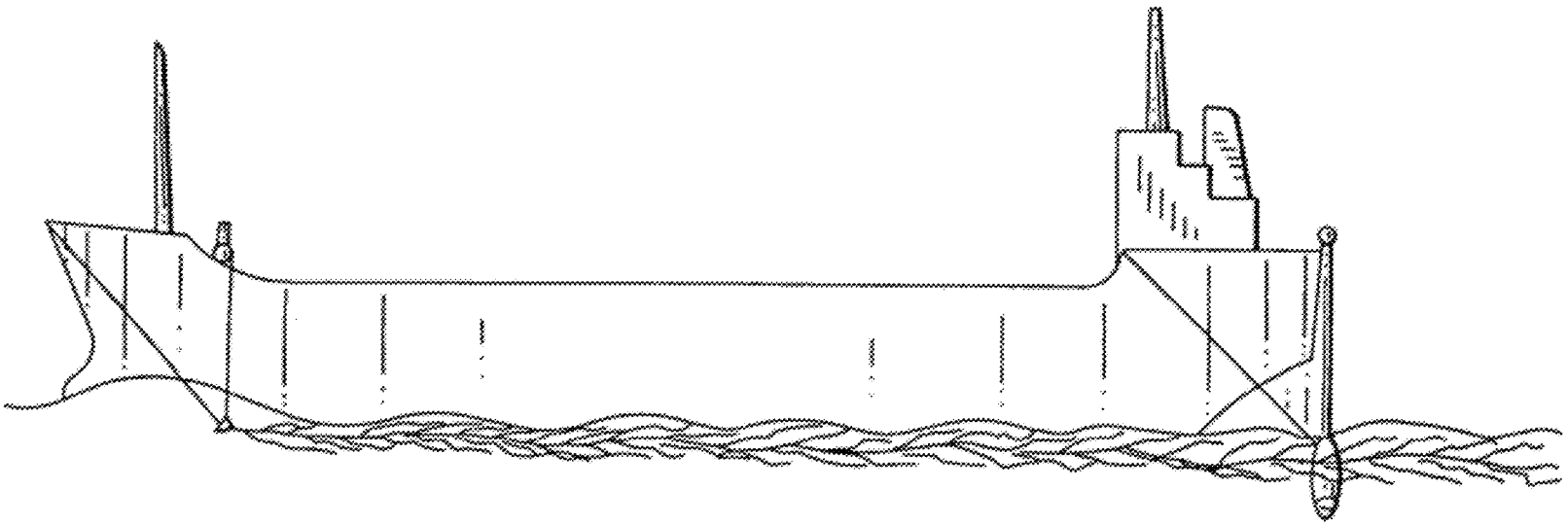
FIG. 1*b* is a port side view of a marine vessel deploying a watercraft immobilizing apparatus and system in accordance with embodiments of the present invention.
Figure 1C:
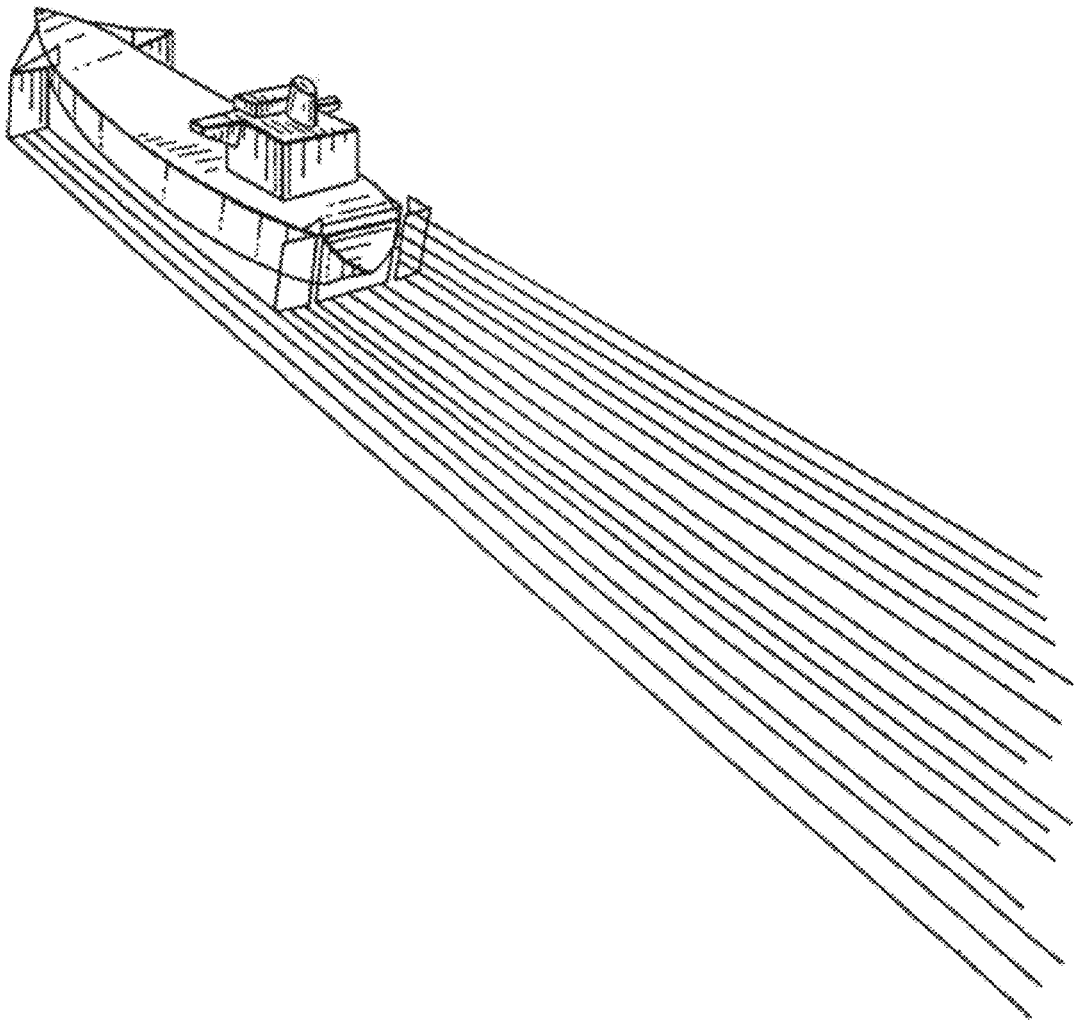
FIG. 1*c* is a perspective view of a marine vessel deploying a watercraft immobilizing apparatus and system in accordance with embodiments of the present invention.

Referring now to the drawing figures, FIG. 1*a* illustrates an exemplary coverage pattern of the towed tendril line array and positioning of main and davit/outrigger tendril line banks relative to the protected vessel. There can be five banks of rollers (transom, port quarter, starboard quarter, port shoulder or bow and starboard shoulder or bow). FIGS. 1*b* and 1*c* show a port side view and a perspective view of the exemplary coverage pattern, respectively.

Figure 2:
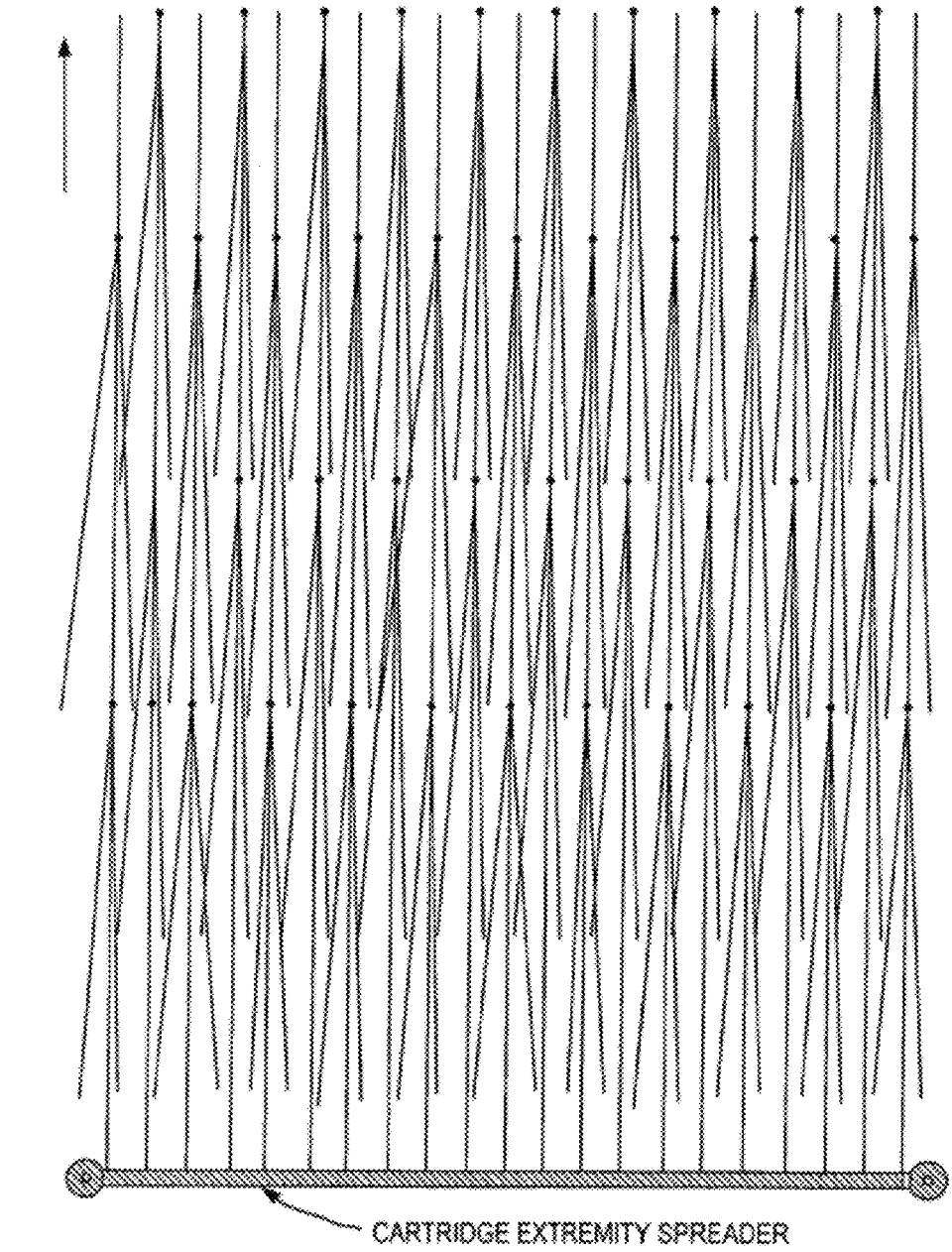
FIG. 2 depicts the extremity (fitted with a spreader) of a cartridge's towed array of tendril lines (staggered secondary line sequence) in accordance with an exemplary embodiment of the present invention.
Figure 9:
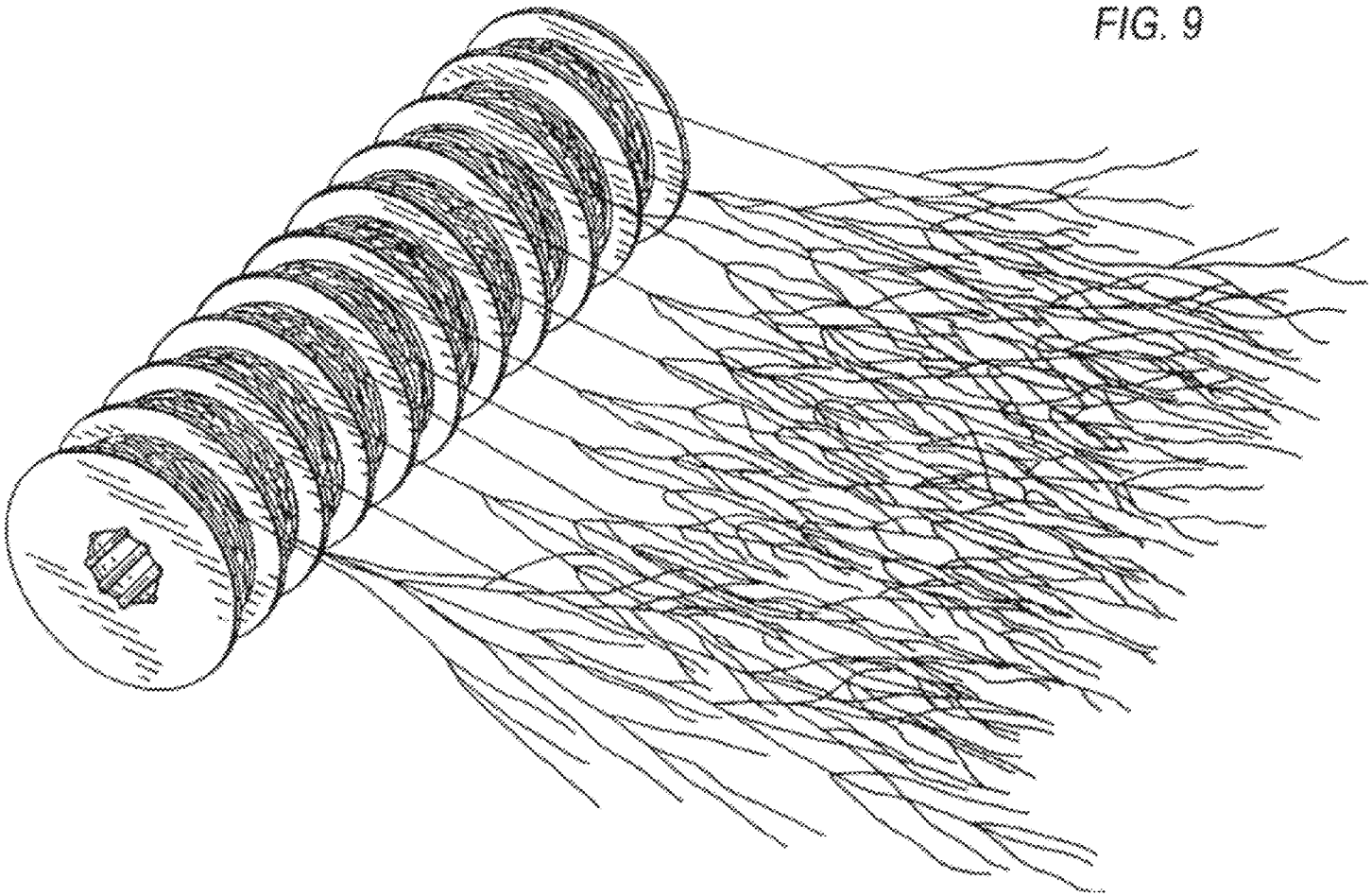
FIG. 9 depicts a loaded cartridge administering primary lines, with secondary and tertiary lines, in accordance with an exemplary embodiment of the present invention.
Figure 10:
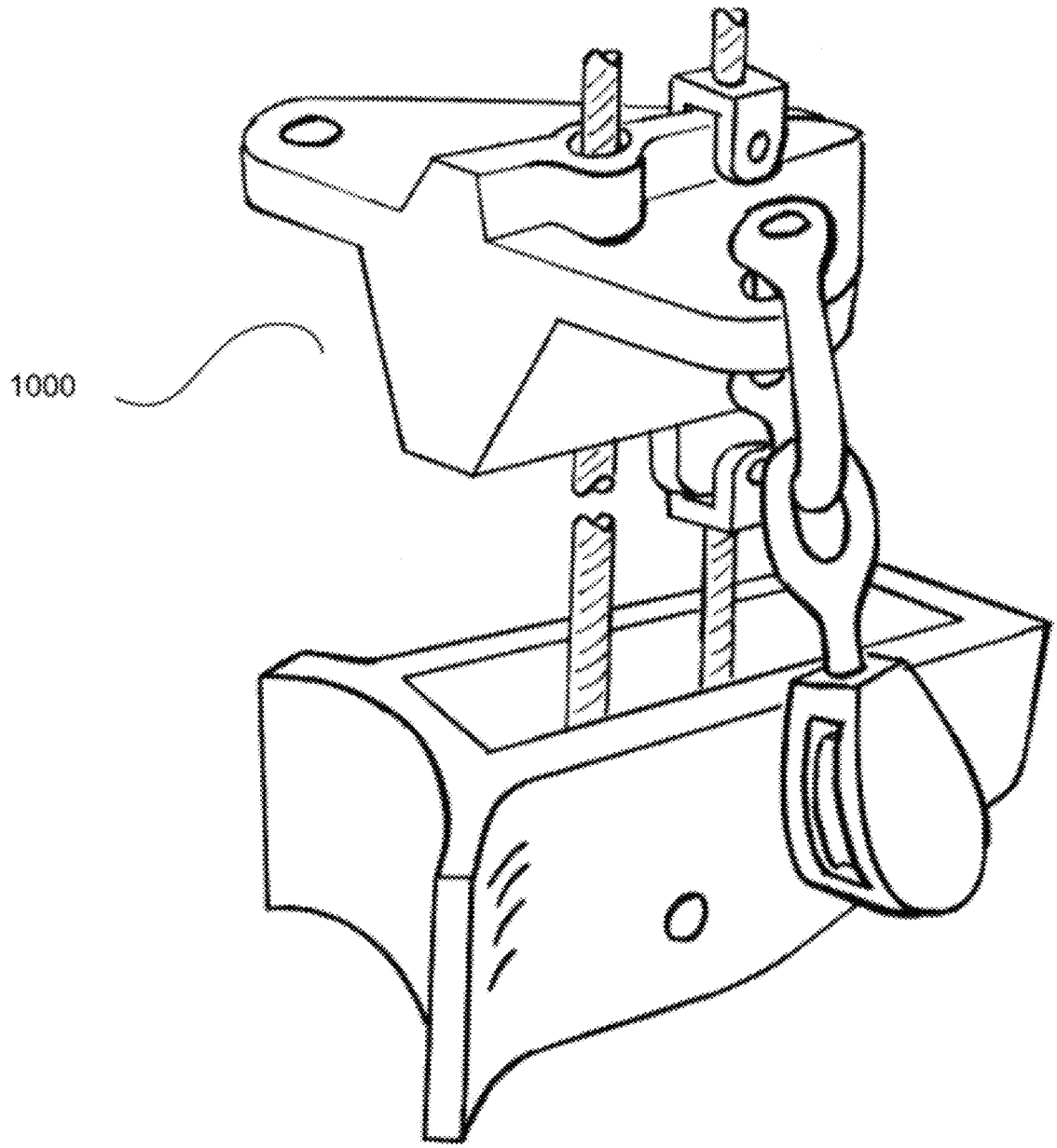
FIG. 10 depicts a traveling block arrangement in accordance with an exemplary embodiment of the present invention.
Figure 11:
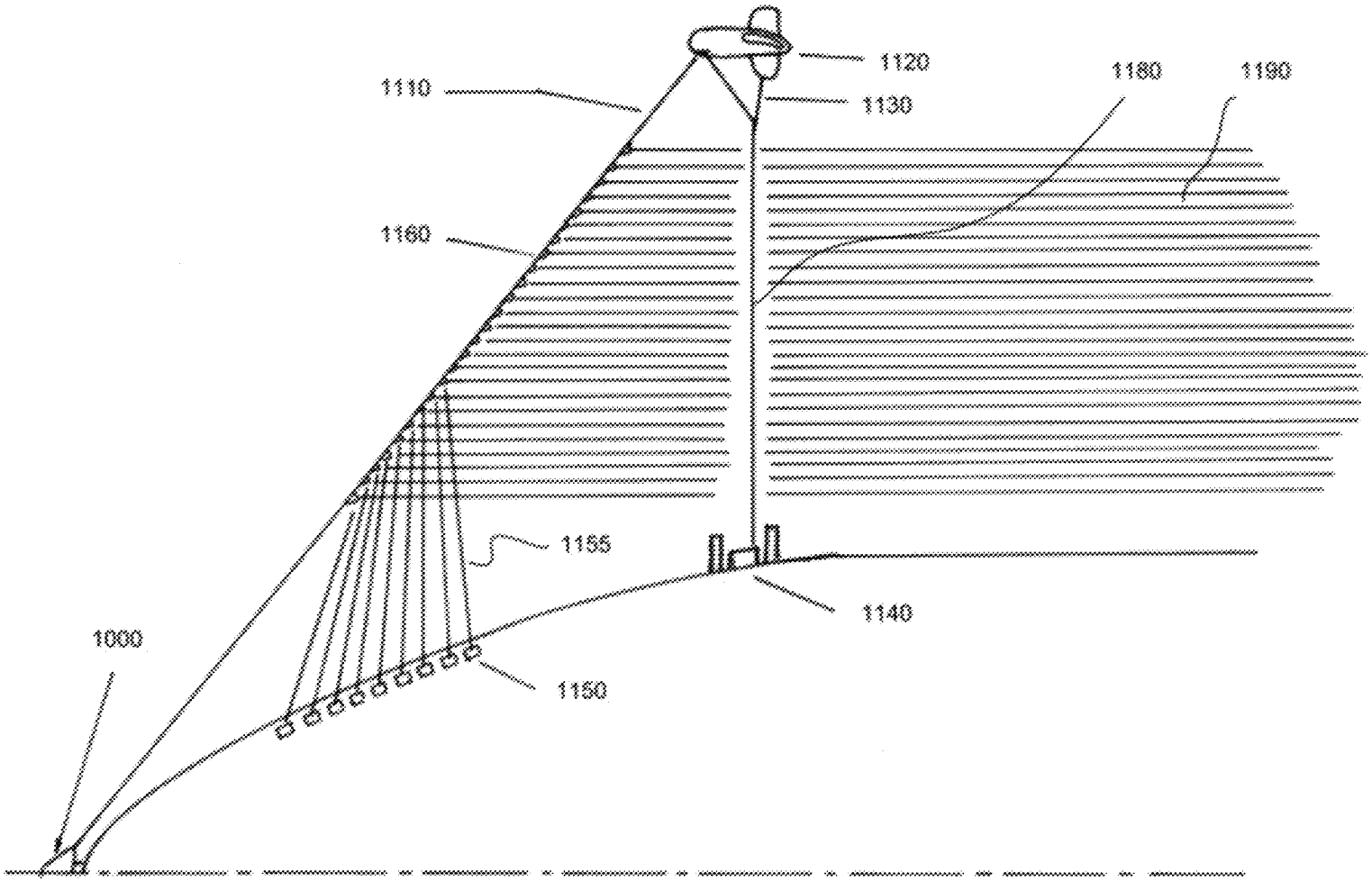
FIG. 11 is a plan view of the forward starboard side of a marine vessel deploying a watercraft immobilizing apparatus and system including a paravane in accordance with embodiments of the present invention.
Figure 12:
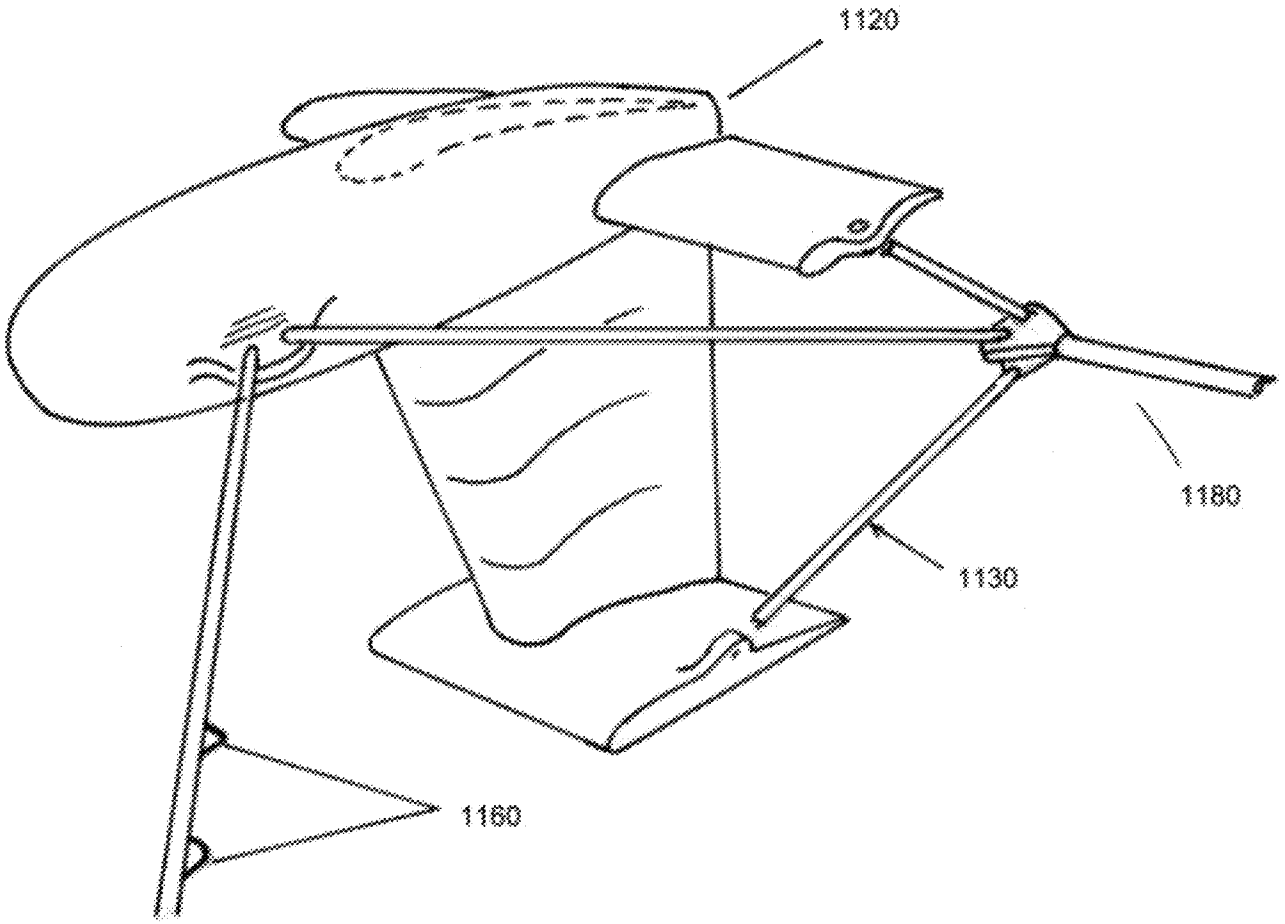
FIG. 12 depicts a floated paravane and bridle assembly in accordance with an exemplary embodiment of the present invention.
Figure 13:
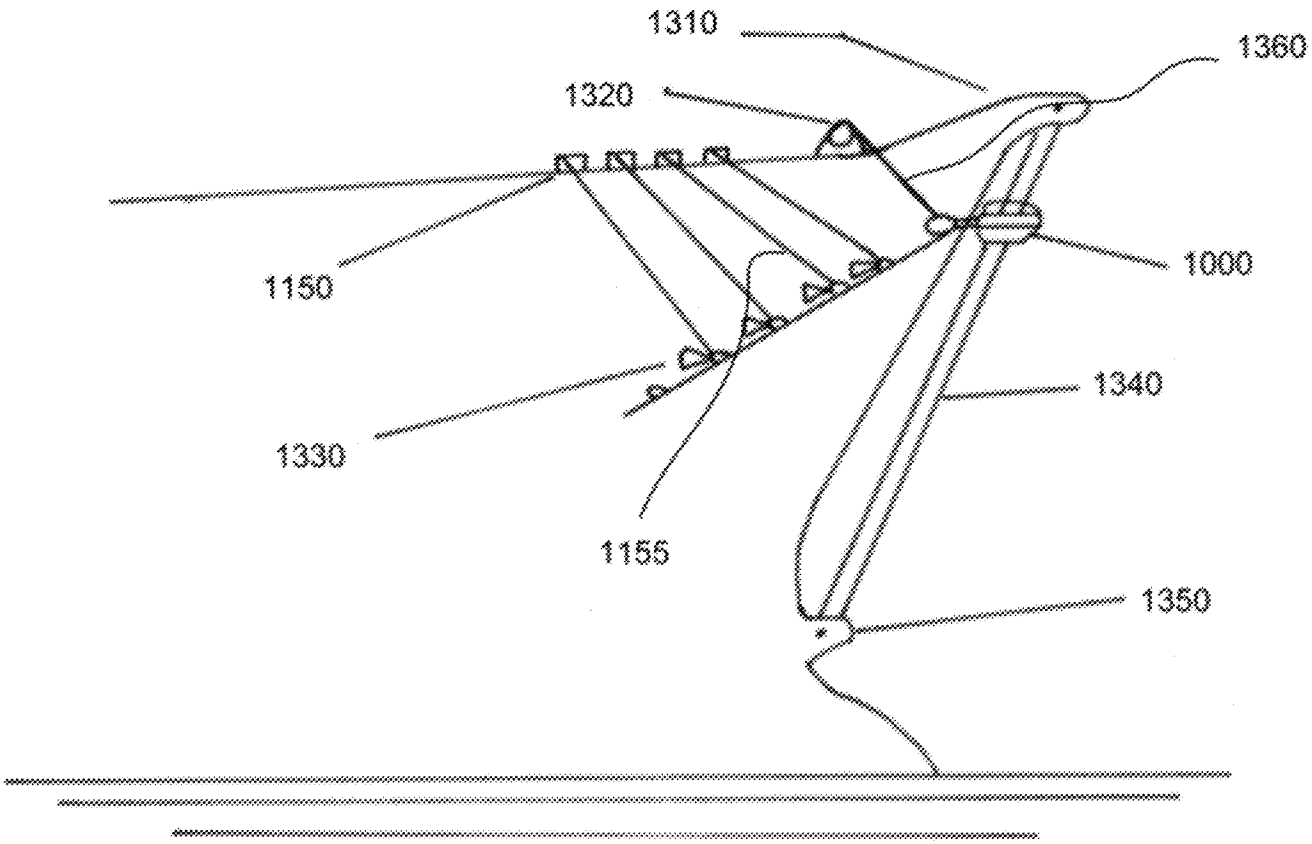
FIG. 13 is a partial side view of a marine vessel deploying a watercraft immobilizing apparatus and system in accordance with embodiments of the present invention
Figure 14:
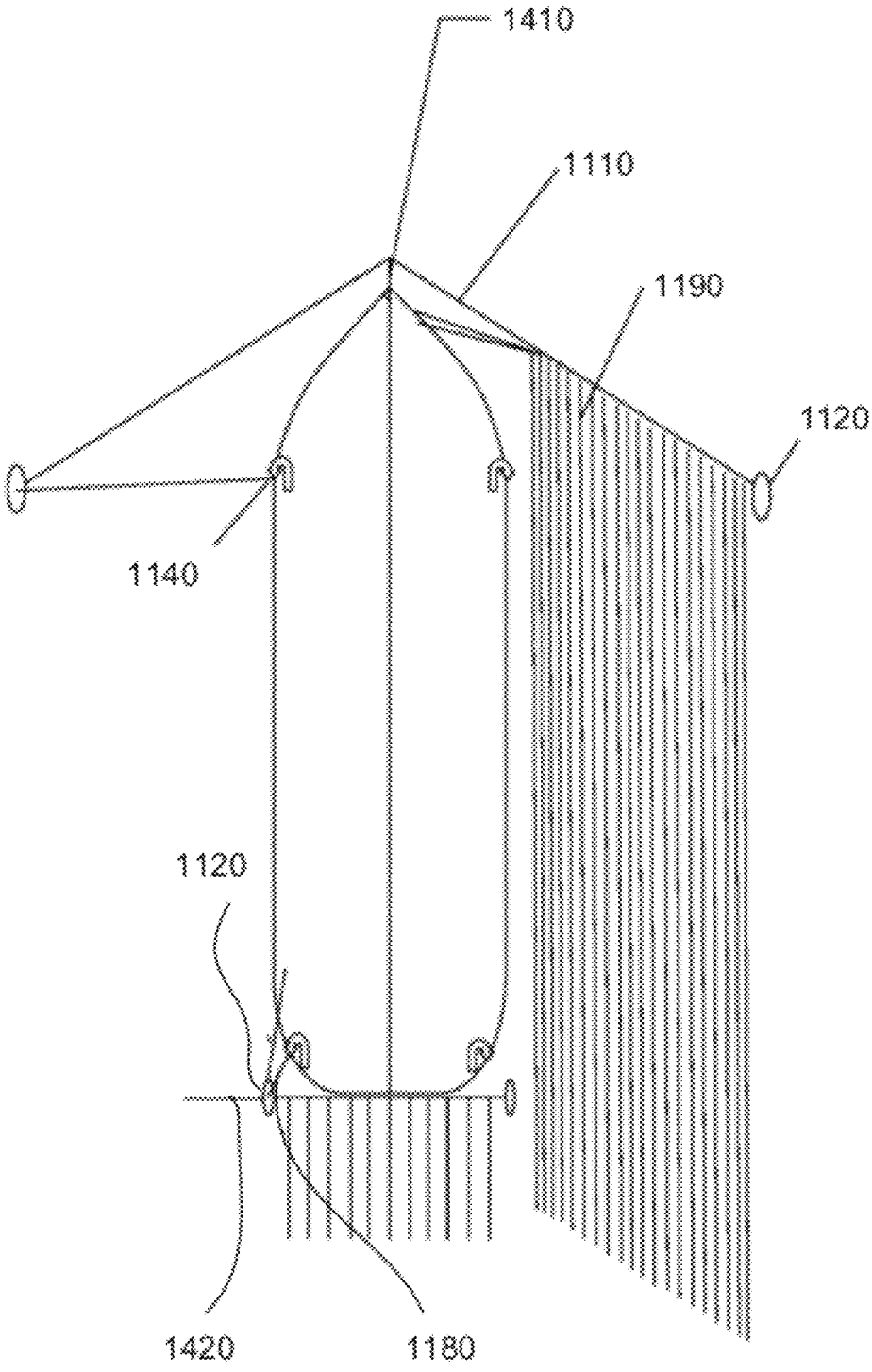
FIG. 14 is a simplified top plan view of a marine vessel deploying a watercraft immobilizing apparatus and system in accordance with embodiments of the present invention including one or more paravanes.

It should be understood that the only locations on the vessel that may not need to be protected by towed arrays are the bow areas, where the bow wave creates a highly dangerous position for smaller boats to attack. However, some embodiments described hereinafter in greater detail provide protection for the bow areas as well.

Where fitted, each bank of rollers (e.g., FIG. 3) can be configured to deploy the cartridges (FIG. 9), which can include multiple main tendril lines suitably spaced to achieve maximum efficiency whilst minimizing the quantity of lines required for deployment (e.g., approximately, four inches apart, or desirably 12 to 24 inches apart). The multiple main tendril lines administered from each cartridge can be weighted/floated for neutral buoyancy and can be fitted with finned end floats and/or spreaders (FIG. 2). The spreaders can be finned for increased underwater stability and/or interlinked to adjacent spreaders. The tendril lines can be provided with the secondary and/or tertiary sub-tendril lines of similar or smaller diameter, with varying lengths and staggered placement of intervals (preferably, of not more than five feet) along the main lines of the towed array.

Where fitted, the submersible rollers need not be heavy, bulky pieces of equipment, and can be deployed from separate electric/hydraulic motors and winches. The submersible rollers can be lowered directly from the storage banks.

Figure 7:
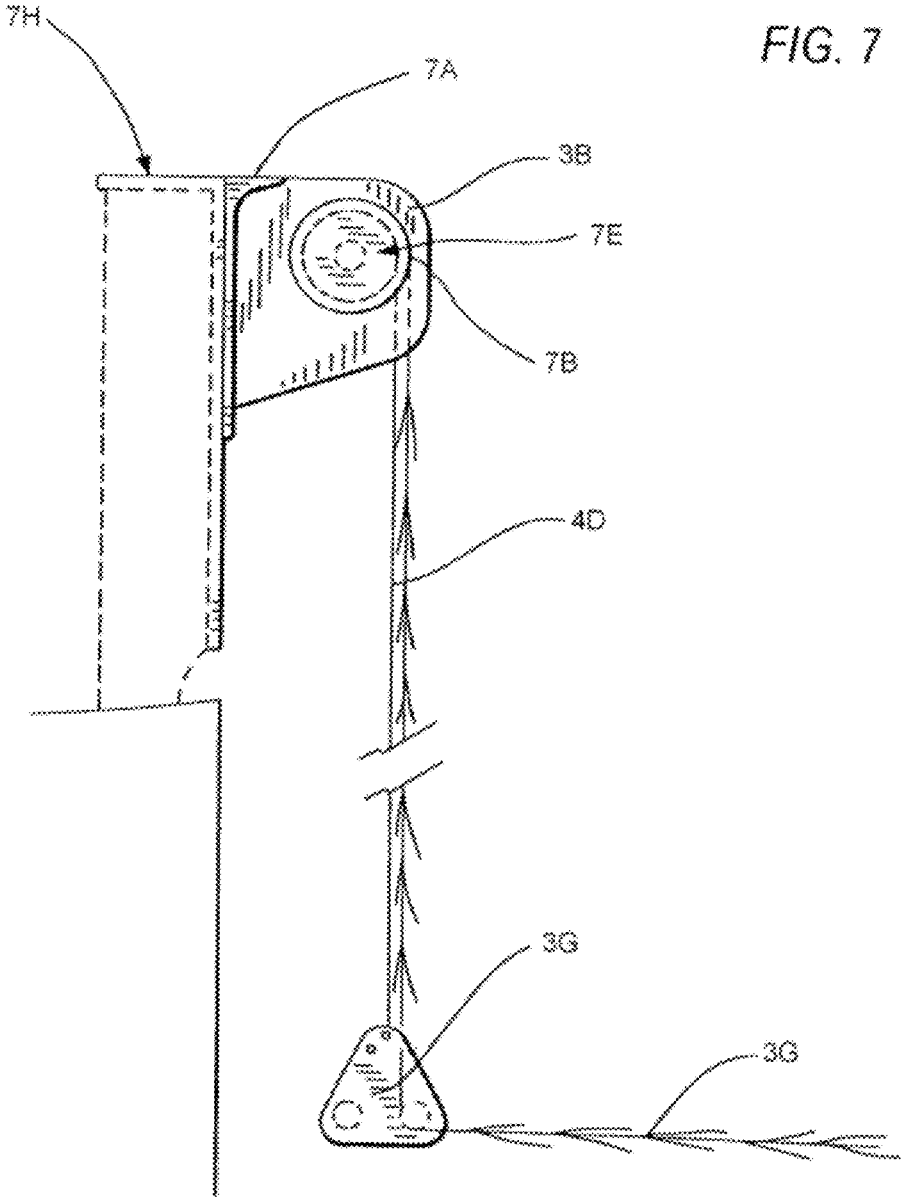
FIG. 7 is a cross-sectional (portside) view through a main transom tendril line bank and submersible weighted rollers in accordance with an exemplary embodiment of the present invention.
Figure 8:
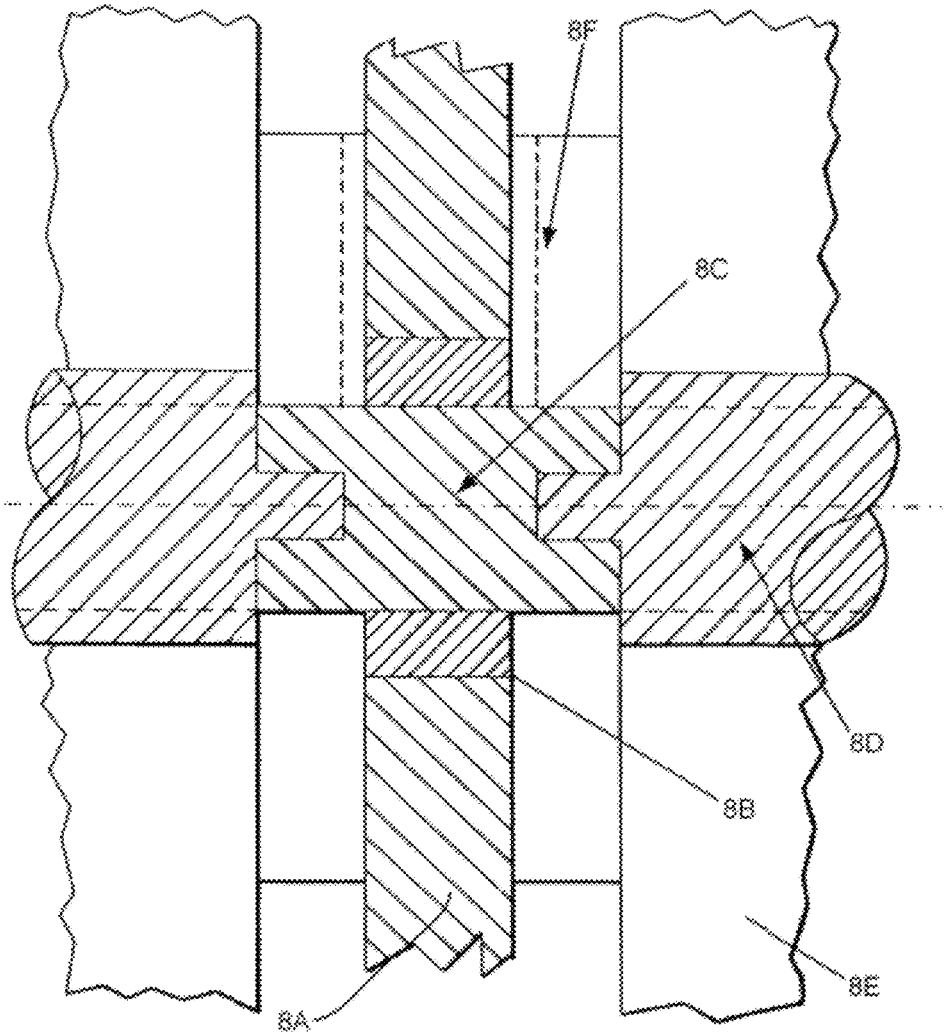
FIG. 8 is a cross-sectional view through a line cartridge in accordance with an exemplary embodiment of the present invention.

The main transom bank of rollers can be fitted by steel brackets to the vessel's existing structures, such as the aft bulwark (FIG. 7). The roller bodies can support multiple flanges that incorporate intermediate (preferably, stainless steel) shafts and bearings. The intermediate shaft ends can be notched to receive the removable cartridge shafts (FIG. 8). These shafts can then be locked into place (e.g., by rotatable locking rings (FIG. 8, element 8F) positioned at each end in the way of the flanges. The cartridge shafts can have splines or key ways (FIG. 8, element 8D) or like elements to prevent the cartridges from rotating on the shaft. The complete shaft assembly can then be driven by a centrally mounted electric/hydraulic motor (FIG. 3, element 3C) that can be remotely controlled (e.g., from the vessel's bridge). This shaft assembly can also be fitted with a locking device to prevent forced rotation when the array is deployed.

The main storage bank (FIGS. 1*a*, 3) can be configured to span the complete width of the vessel's transom. Due to the different breadths of vessels, the aft roller system at the transom can be expandable to cover the full transom (e.g., via segment extensions to the cartridges).

For example, two stern quarter outriggers/davits (FIG. 1*a*) can each be fitted adjacent to the main transom bank on one or more of the port and starboard sides of the vessel. The stem outriggers and banks can be situated aft of the vessel's rudder and propeller to prevent fouling. The stem outriggers (FIG. 3) can deploy parallel extensions of the main transom towed array to the full width of the protected vessel's body. Ideally, the length of the quarter outriggers is proportional to the difference between the length of the main transom bank and the overall beam of the vessel being protected. The stem outriggers can be smaller than the forward outriggers, which can be also be fitted. The towed stern array can spread out by the forward movement of the vessel and extend aft of the vessel to any desirable length.

Where fitted and deployed, the stem quarter outriggers can be in a generally perpendicular position, but the outriggers can also be rotated parallel to the vessel's main axis and removed when not in use and locked in stowed or deployed positions. The body of the outrigger can similarly support multiple flanges that incorporate intermediate (preferably, stainless steel) shafts and bearings. The intermediate shaft ends can be similarly notched to receive the removable cartridge shafts that are similarly locked in place. The complete quarter outrigger shaft assemblies can then be driven by inboard mounted electric/hydraulic motors, which can be remotely controlled. These quarter outrigger shaft assemblies can also be fitted with locking devices to prevent forced rotation when the tendril array is deployed.

Figure 3:
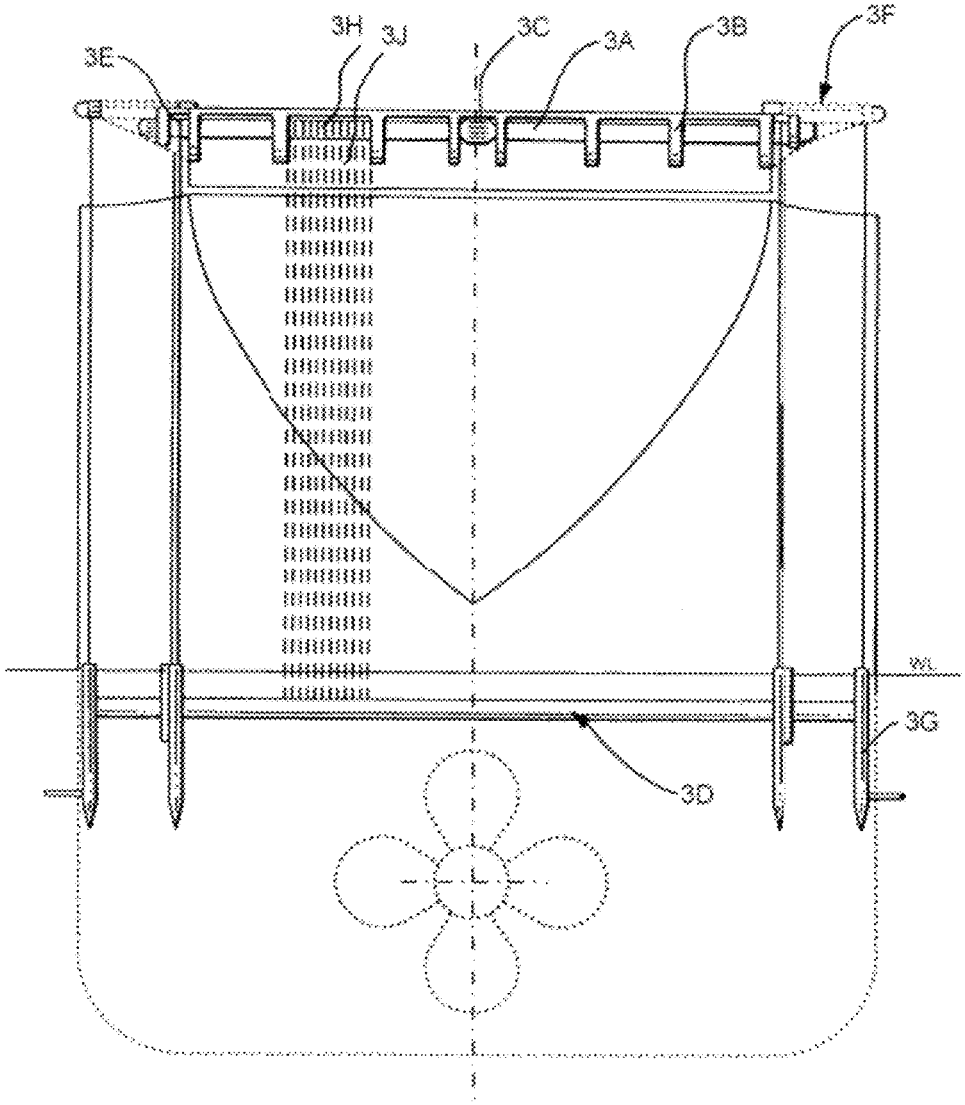
FIG. 3 is a stern (transom) view (including below the water line) of a vessel deploying a watercraft immobilizing apparatus and system in accordance with embodiments of the present invention, illustrating exemplary positioning of a main transom tendril line bank with six cartridges, cartridge mounts/bearings, main bank electric drive motor, submersible weighted dual rollers, supporting winch/motor, stern outrigger assembly, deep fin, and towed array lines (shown administered from a single cartridge)
Figure 4:
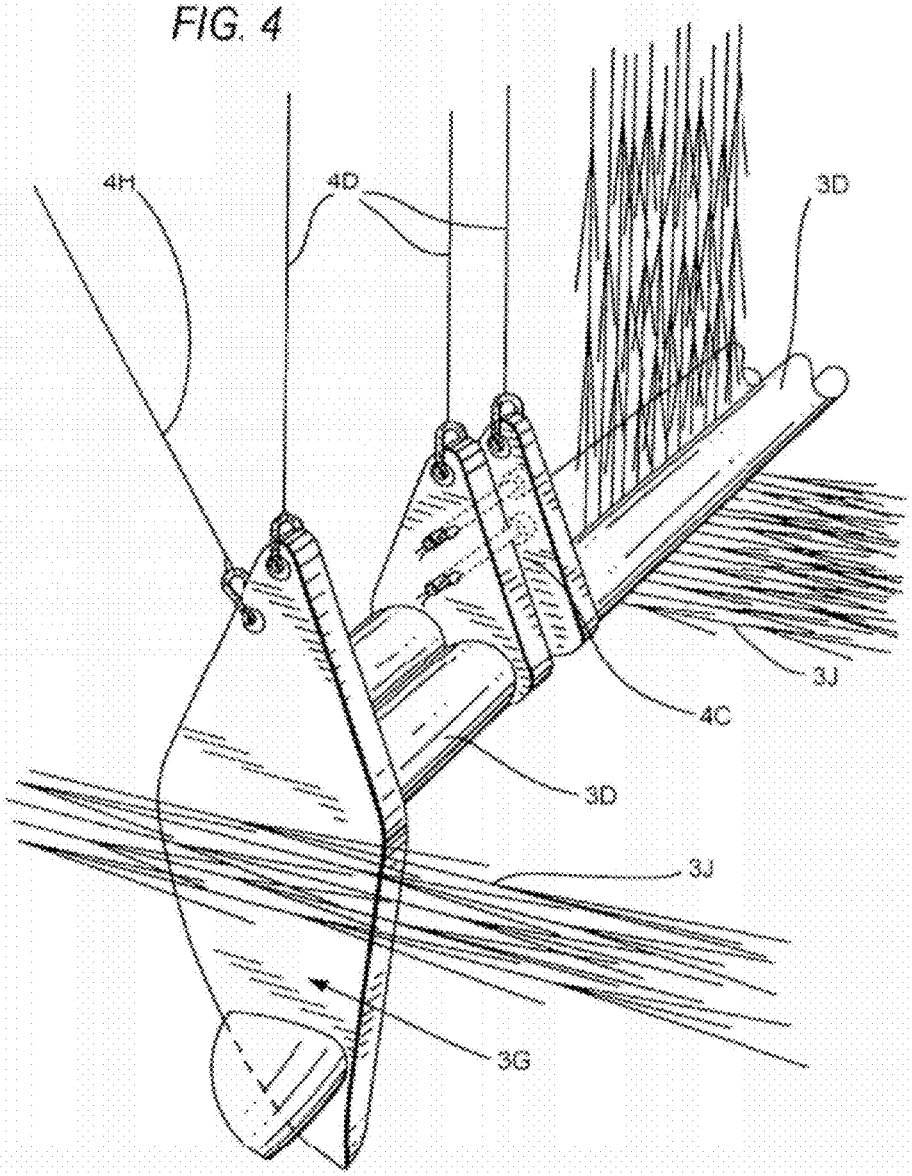
FIG. 4 depicts weighted sub-surface dual rollers of a main transom tendril line bank and a stern outrigger bank (portside), cross connection, main support wires, deep-finned side and stern towed arrays, and portside fore stay in accordance with an exemplary embodiment of the present invention.

Secondary winches, similarly powered by electric/hydraulic motors, can be situated at the extremities of the quarter outrigger storage bank rollers. These winches can store the support wires for the quarter outrigger bank dual submersible weighted rollers (FIGS. 3 and 4). These winches can be similarly locked when the dual submersible rollers are deployed. The submersible rollers can lock into place adjacent to the main transom dual submersible rollers to form a substantially rigid unit (FIG. 4). These units can similarly place the towed array at or below the water surface and, e.g., immediately below the quarter outrigger storage banks. The outboard extremities of these submersible dual rollers can be fitted with deep fins (FIG. 3, element 3G) to prevent the towed side arrays from coming into contact with the protected vessel's own propeller(s). The submersible dual roller extremities can also be fitted with fore stays (FIG. 4) to prevent the assembly from riding aft and away from the vessel's transom.

Alternatively, or in addition, secondary winches (FIG. 3, element 3E) similarly powered by electric/hydraulic motors can also be provided at the main transom bank. These winches can store the support wires for the main transom bank dual submersible weighted rollers (FIG. 3, element 3D and FIG. 4, element 3D). The winches can be similarly locked when the dual submersible rollers are deployed. The submersible rollers can place the towed array at or below the surface of the water, e.g., immediately below the transom storage bank.

In some embodiments, forward shoulder outriggers (FIGS. 1*a*, 5, and 6) can also be configured to deploy side towed arrays (e.g., not less than twenty feet in width/span) off the port and starboard sides of the vessel. These side towed arrays can extend aft to a desired length and can overlap the stern mounted towed array, outboard of the deep fin positioned at the extremities of the stern quarter dual submersible roller.

Figure 5:
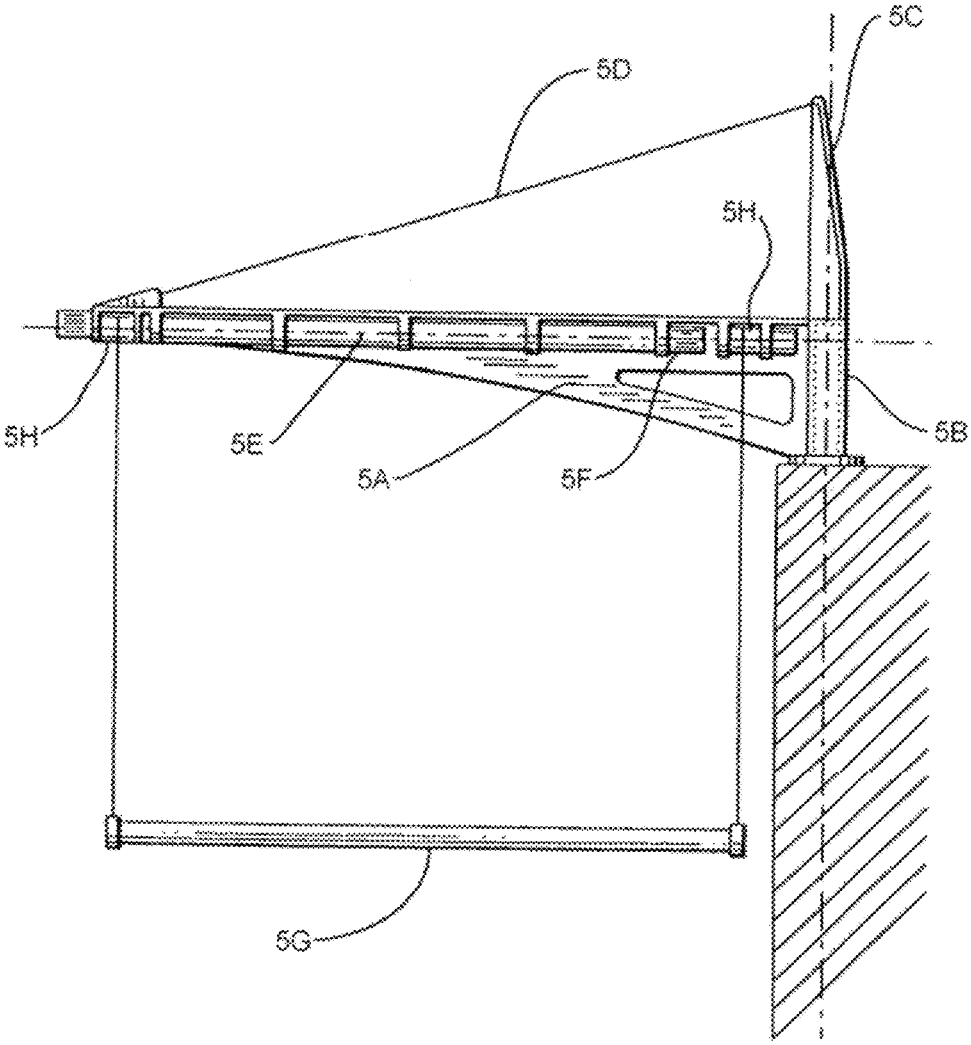
FIG. 5 is an aft view of a portside shoulder outrigger assembly with submersible weighted rollers in accordance with an exemplary embodiment of the present invention.
Figure 6:
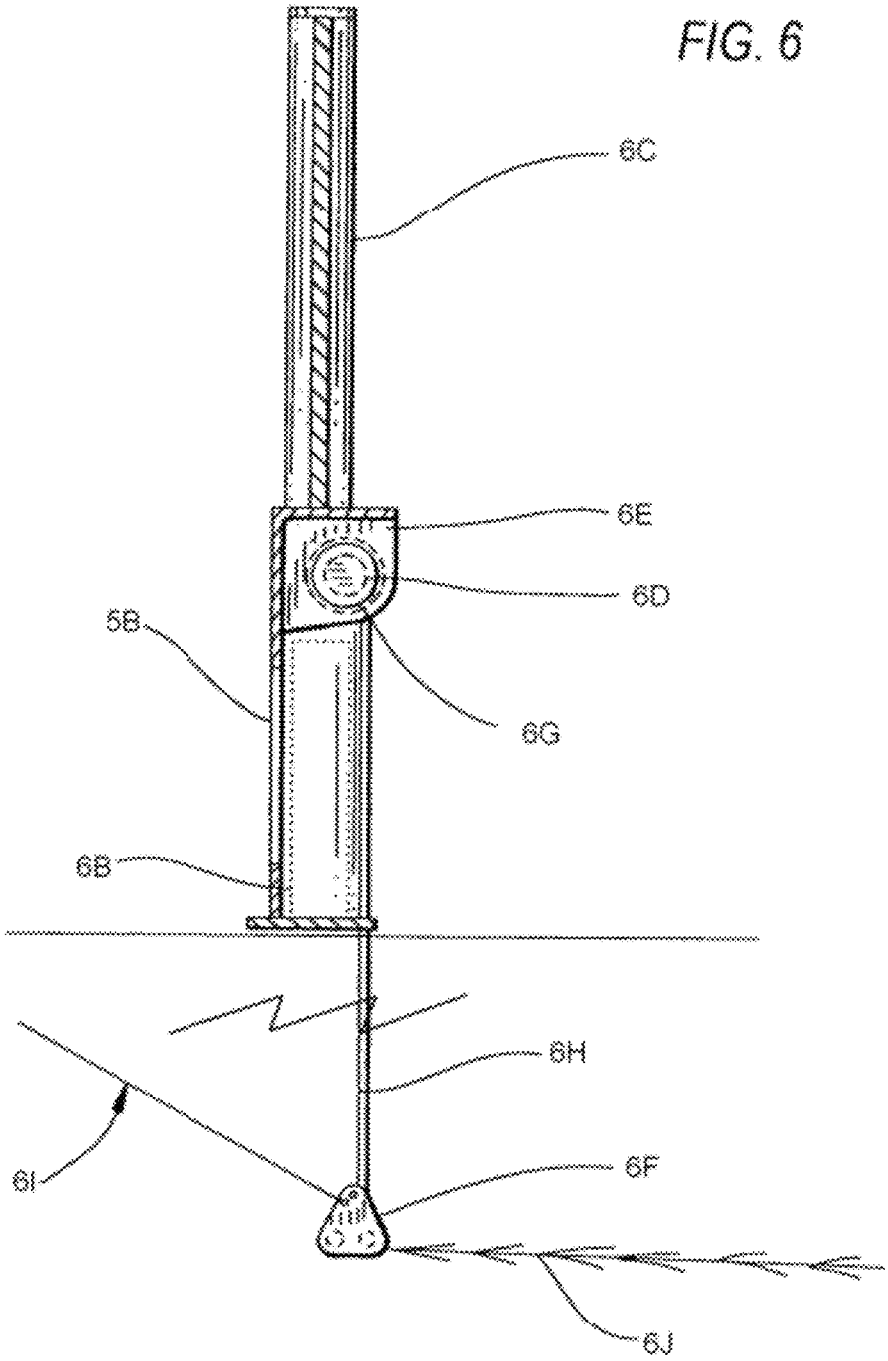
FIG. 6 is a side view of a portside shoulder outrigger assembly with submersible weighted rollers in accordance with an exemplary embodiment of the present invention.

These forward outriggers, which can be situated at the port and starboard shoulders of the protected vessel, can be configured to be the same as or similar to the stem quarter outriggers. In some embodiments, the forward outriggers can be larger than the stern quarter outriggers. These forward outriggers can also be rotated parallel to the vessel's main axis when not in use and locked in stowed or deployed positions. The body of each outrigger can similarly support multiple flanges that incorporate intermediate (preferably, stainless steel) shafts and bearings (FIG. 8). The intermediate shaft ends can be similarly notched to receive the removable cartridge shafts, which can be similarly fixed in place by the rotatable locking ring (FIG. 8, element 8F). The complete shoulder outrigger shaft assemblies can then be driven by inboard mounted electric/hydraulic motors, which can be remotely controlled (e.g., from the vessel's bridge). These shoulder outrigger shaft assemblies can also be fitted with locking devices to prevent forced rotation when the tendril line array is deployed. Like the main transom and stern outrigger assemblies, secondary winches similarly powered by electric/hydraulic motors can also be provided at the extremities of the forward shoulder outrigger storage bank rollers. These winches store the support wires for the forward shoulder outrigger bank dual submersible weighted rollers (FIG. 5, element 5G). The winches can be similarly locked when the dual submersible roller system is deployed. The submersible dual roller extremities can also be fitted with fore stays connected via bridles (FIG. 6, element 6I) to prevent the assembly from riding aft and away from beneath the shoulder outrigger assembly.

The towed side arrays themselves can cause a vector of force away from the vessel and can help hold the forward submersible rollers off the vessel's side. The rollers can also be fendered on the inboard side. Also, the rollers can be segmented (e.g., cartridge width—every five feet) and fitted with cutting edges to sever lines entangled between adjacent cartridges to allow more efficient re-spooling. The cartridges themselves can have intermediate flanges to segment tendril line.

Similar to the towed stern arrays, the trailing spreaders of the towed side arrays can inter-connect (attach between each cartridge) and form a substantially rigid boom. The towed side array spreaders can also be finned to encourage movement out and away from the side of the protected vessel. The towed side arrays can be run out to the approximate turning circle of the vessel.

Referring now to FIGS. 10-16, alternatively, or in addition to the embodiments described above, the watercraft immobilizing system can include one or more floated booms and respective paravanes for towing the arrays. For example, in some embodiments, the system can include one or more paravanes 1120, each towed by a transverse submersible wire/chain 1180 (e.g., that can also be recoverable) and by a forward floated boom 1110 (e.g., on port and starboard sides) that can deploy side towed arrays 1190 (e.g., of not less than one hundred feet in width/span) off the port and starboard sides. Side towed arrays 1190 can extend aft, e.g., at least 150 feet, and can overlap the stern mounted towed array, outboard of the deep fin positioned at the extremities of the stern quarter submersible wire or chain. Floated boom 1110 can spread out (e.g., 20 to 30 degrees abaft the bow) via towed paravane 1120. In some embodiments, each paravane 1120 and respective floated boom 1110 can mutually hold each other in position.

Floated boom 1110 can be situated at port and/or starboard sides of the vessel and streamed from a traveling block 1000, a folding bowsprit 1410, and/or a hard connection 1560 to the hull of the vessel. Floated boom 1110 can provide a barrier, hence affording enhanced protection at the bow. It should be understood that a primary purpose of the floated booms (and the submersible rollers of the embodiments described above) is to get the tendril lines into the water directly below or forward of the deployment banks (e.g., FIG. 11).

Paravanes 1120 can be stored and deployed by davit/outrigger 1140 fitted on port and/or starboard sides of the vessel (e.g., at the extremities and to the vessel's focsle and/or poop deck). Davit/outrigger 1140 can also be operated manually or remotely by electric/hydraulic motor. In some embodiments, each davit/outrigger 1140 can be powered by electric/hydraulic motors to deploy paravane 1120 via an interconnecting transverse submersible wire/chain 1420 (that can support rollers). Each paravane 1120 can also be towed from floated boom 1110 and/or separate recovery wires 1180 streamed from forward positions to prevent the paravane and transverse submersible wire/chain 1420 from trailing aft of the transom. Paravane 1120 can prevent the possibility of the lines of the towed side arrays 1190 from fouling the vessel's own propeller(s). In some embodiments, bridle 1130 can be configured to couple paravane 1120 and recovery wire 1180 and/or transverse submersible wire/chain 1420.

In some embodiments, tendril lines of the main stern bank can be fed through links of interconnecting submersible wire/chain 1420 (or rollers supported by interconnected wire/chain 1420), which can hold the tendril lines in/on the water below (e.g., immediately below) the transom. Interconnecting submersible transverse wire/chain 1420 can be held tight, due to the tensile force that can be created by the angle of the fins in way of the paravanes.

In some embodiments (see e.g., FIGS. 10, 11, and 13), the floated boom and paravane assembly can be deployed via winch 1310 and traveling block 1000, which can travel along wire/chain haul 1340 secured to fixed block 1350. For example, winch 1320 can store extension lines, wires, or chains 1360, which can deploy floated boom 1110, and winches 1150 can also be included and configured to store extension lines, wires, or chains 1155, which can also deploy (or assist in deploying) floated boom 1110. In some embodiments, in addition to towed paravane 1120, smaller paravanes 1330 (which can be interconnected) can also be attached to the ends of the wires 1155.

In some embodiments (see e.g., FIGS. 11 and 14), the floated boom and paravane assembly can be deployed via bowsprit 1410 of the vessel, and traveling block 1000 may not be necessary.

Figure 15:
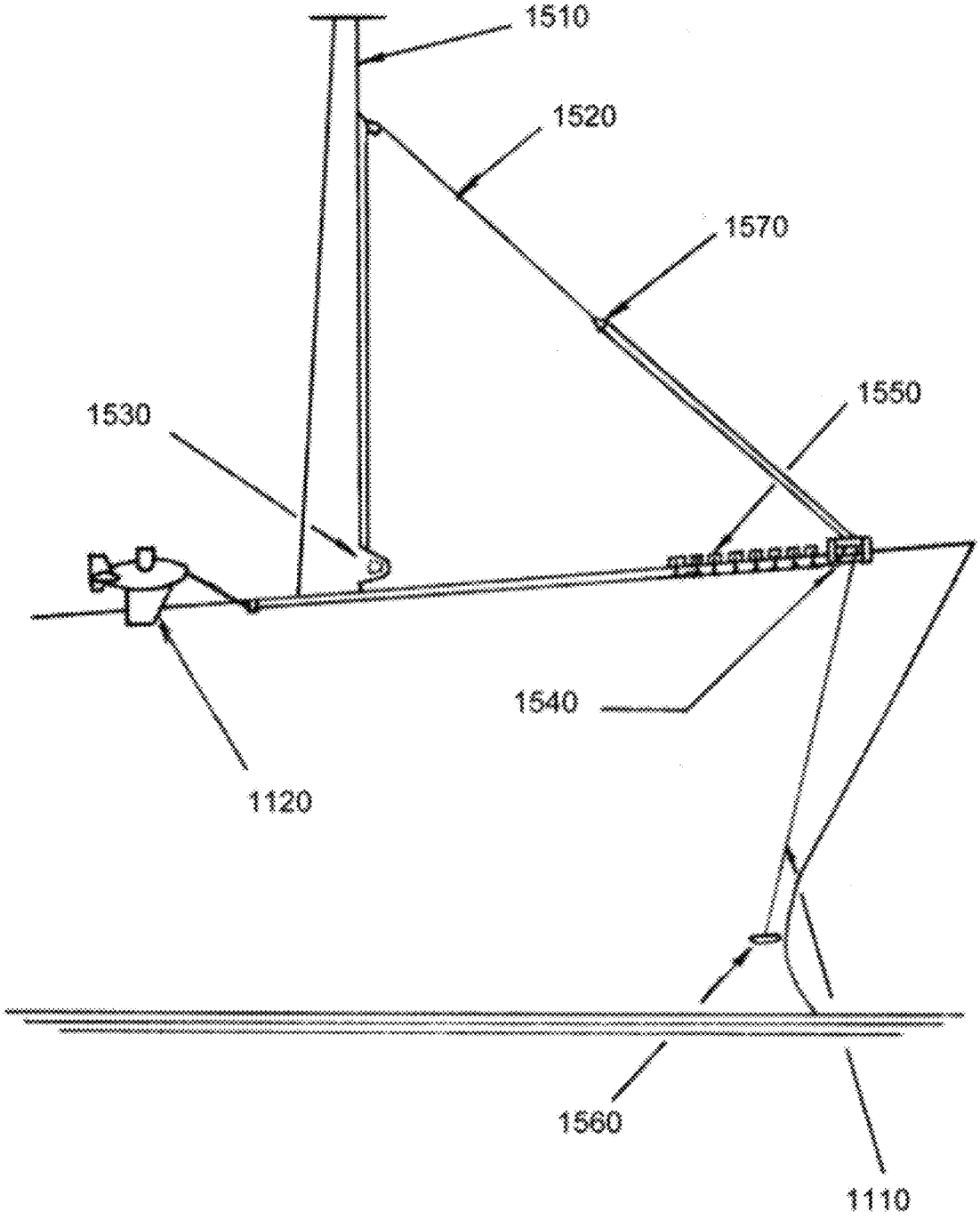
FIG. 15 is a starboard view of a marine vessel deploying a watercraft immobilizing apparatus and system in accordance with embodiments of the present invention including a hard connection of a boom to the hull of the vessel.
Figure 16:
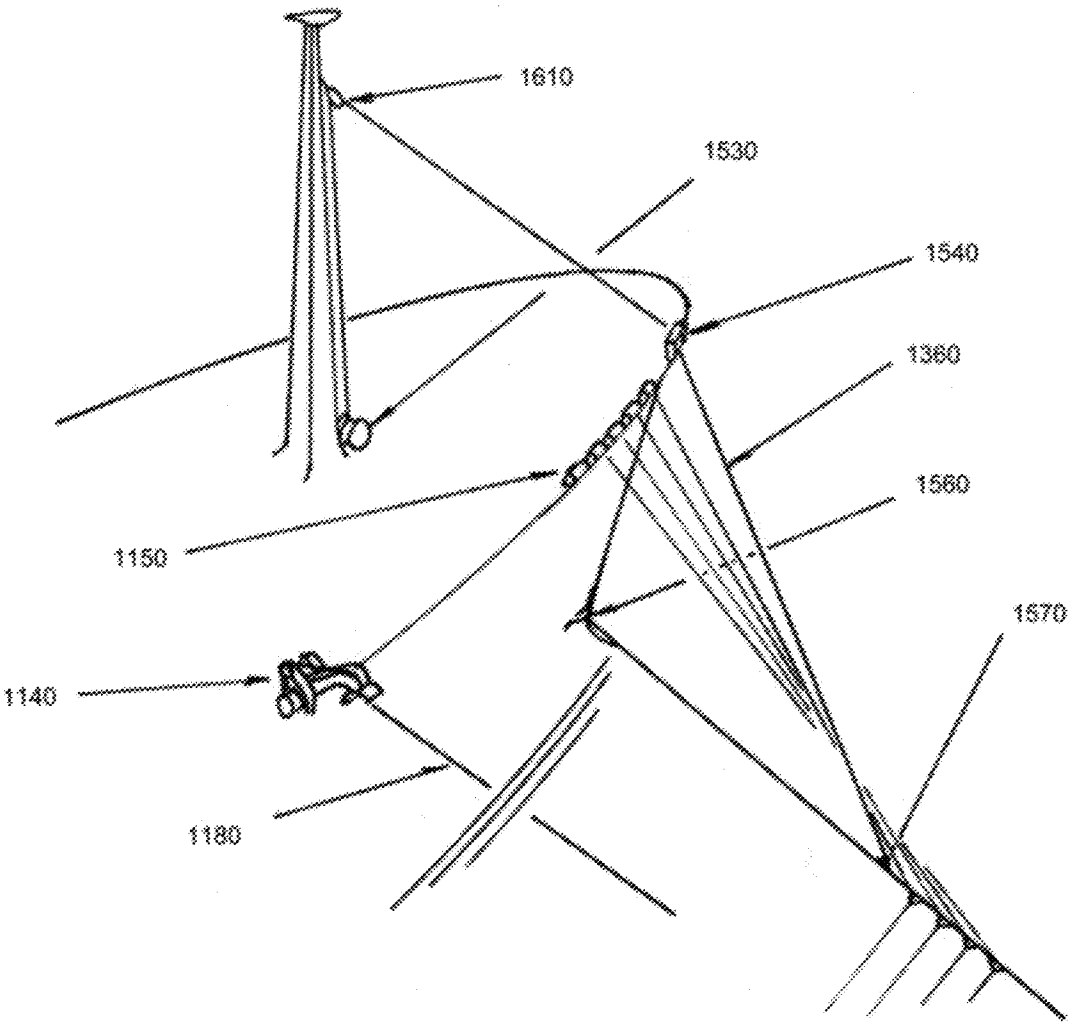
FIG. 16 is a starboard view of a marine vessel deploying the watercraft immobilizing apparatus and system shown in FIG. 15, with a paravane in a deployed position.

In some embodiments (see e.g., FIGS. 15 and 16), the floated boom and paravane assembly can include a hard connection 1560 to the hull of the vessel that couples floated boom 1110. Floated boom 1110 can then be deployed and/or stored via one or more of roller 1540, winches 1550, and up-haul winch 1530 (e.g., double drum), such that floated boom 1110 can be stored in a bight, which can be suspended from mast head block 1610 (e.g., coupled to foremast 1510 of the vessel) via wire 1520 coupled to the floating boom via connector 1570. Both port and starboard bights can be deployed from the same double drum winch 1530 at the base of foremast 1510. For example, FIG. 15 is a view of a starboard side of a vessel with a forward paravane 1120 in an elevated and stowed position. Floated boom 1110 can be coupled directly to the hull via hard connection 1560, which can be in alternative to, or in addition to, utilizing traveling block 1000 and/or folding bowsprit 1410.

Irrespective of whether traveling block 1000, bowsprit 1410, or hard connection 1560 is employed, rollers can be fitted to feed the tendril lines (e.g., of transom and/or focsle storage banks on port and starboard sides) on or into the water.

Figure 17:
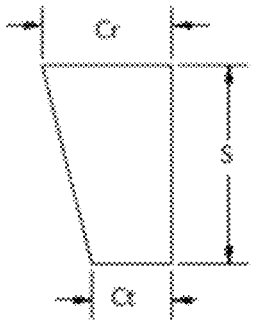
FIG. 17 shows the shape of a paravane including a single rudder blade in accordance with embodiments of the present invention.

Referring to FIGS. 17-22, paravane 1120 can be a part of the system that creates the horizontal force away from the vessel and keeps the forward floated booms 1110 spread out from the side of the hull. Entanglement tendrils can then be fed into the water from eyes/rollers 1160 situated on floated boom 1110. This is salutary as it affords better protection of the vessel's bow and hull sides. Paravane 1120 can include a single rudder blade with the shape as depicted in FIG. 17, where:

Cr=root chord,

Ct=tip chord, and s=span.

By definition, the force generated on an airfoil has two components: the drag and the lift. Lift is always perpendicular to the flow. The drag component is also known as "induced drag" and can be calculated using the following formula:

$$L=C_D 0.5\rho SV^2$$

Where:

ρ is the density of the water,

S is the area of the blade,

V is the speed, and $C_D$ is the coefficient of lift.

The lift created, which should balance the drag generated by the entanglement tendrils and the boom, can be described by the following formula:

$$L=C_L 0.5\rho SV^2$$

where:

ρ is the density of the water,

S is the area of the blade,

V is the speed, and $C_L$ is the coefficient of lift.

Figure 18:
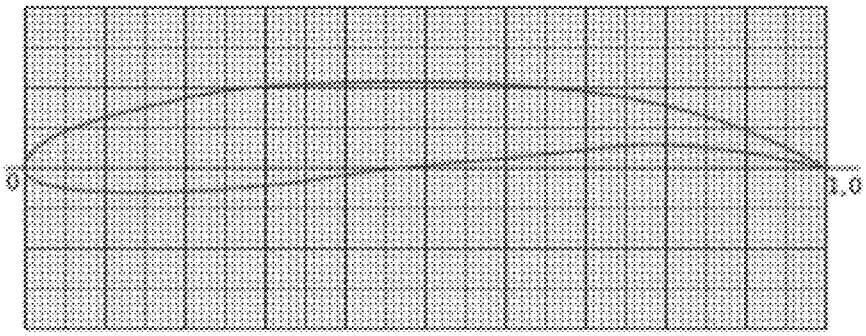
FIG. 18 shows a cross-sectional profile that provides a lift of a paravane in accordance with embodiments of the present invention.

The dimension of the blade can be determined by the lift requested. Determination of the lift coefficient can depend primarily on the angle of attack and also on the cross-sectional profile of the blade. The cross-sectional profile giving a suitable (which can be the best) lift is that of the NACA 6712 as illustrated in FIG. 18.

Figure 19:
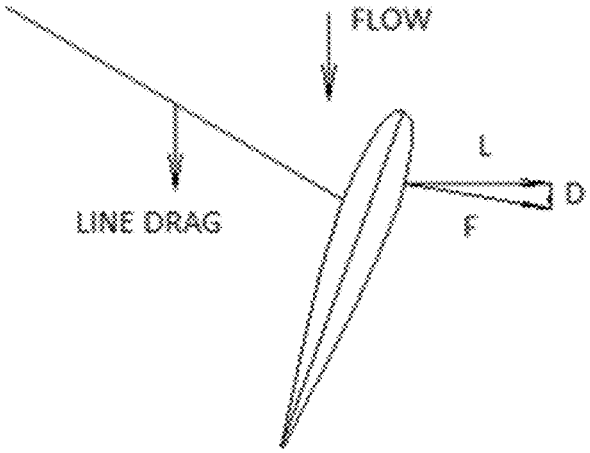
FIG. 19 illustrates forces taken into account when determining induced drag of a paravane in accordance with embodiments of the present invention.

The forces to be taken into account are illustrated in FIG. 19, where F=force generated on the airfoil; D=drag induced by the airfoil; and L=lift generated by the airfoil.

Figure 20:
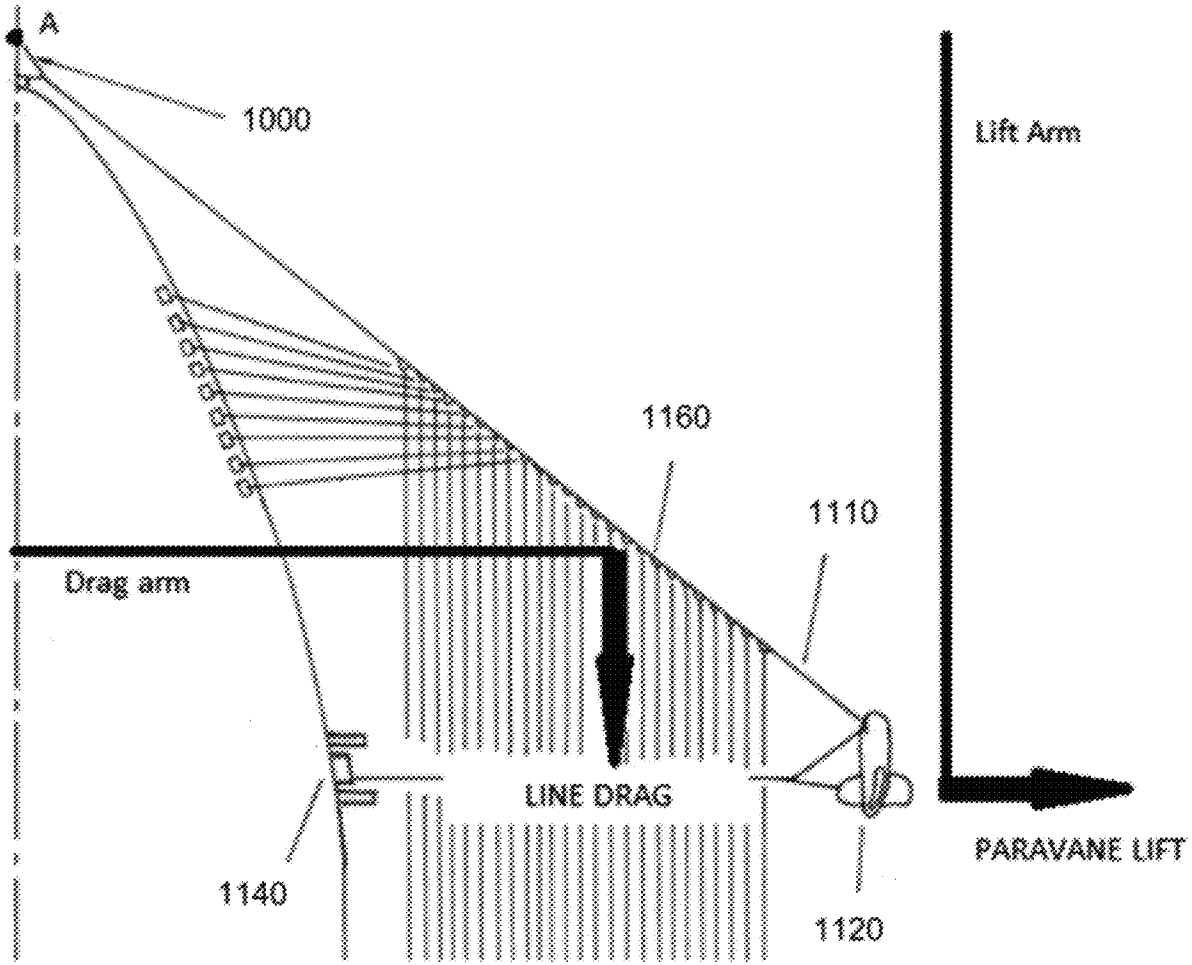
FIG. 20 illustrates forces involving tendril lines, a vessel, and a paravane in accordance with embodiments of the present invention.

In order to balance the tendril drag, the moment (about the bow) of the lift should equal the moment (about the bow) of the total drag, generated by the tendrils and boom; the forces and relative arms with respect to the bow (Point A) are shown in FIG. 20.

The tendril drag is being considered as concentrated at half length of the boom. In calculating the moments, the arms of drag and lift are:

Drag: half of the boom length+clearance from the side of the vessel+half of the width of the vessel; and Lift: lift between the paravane and the bow of the vessel (point A)=length of the forecastle.

The relevant data for the chosen profile can be found in the National Advisory Committee for Aeronautics Report No. 460, titled "*The Characteristics of* 78 *related airfoils sections from tests in the variable-density wind tunnel*" published in 1935.

Figure 21:
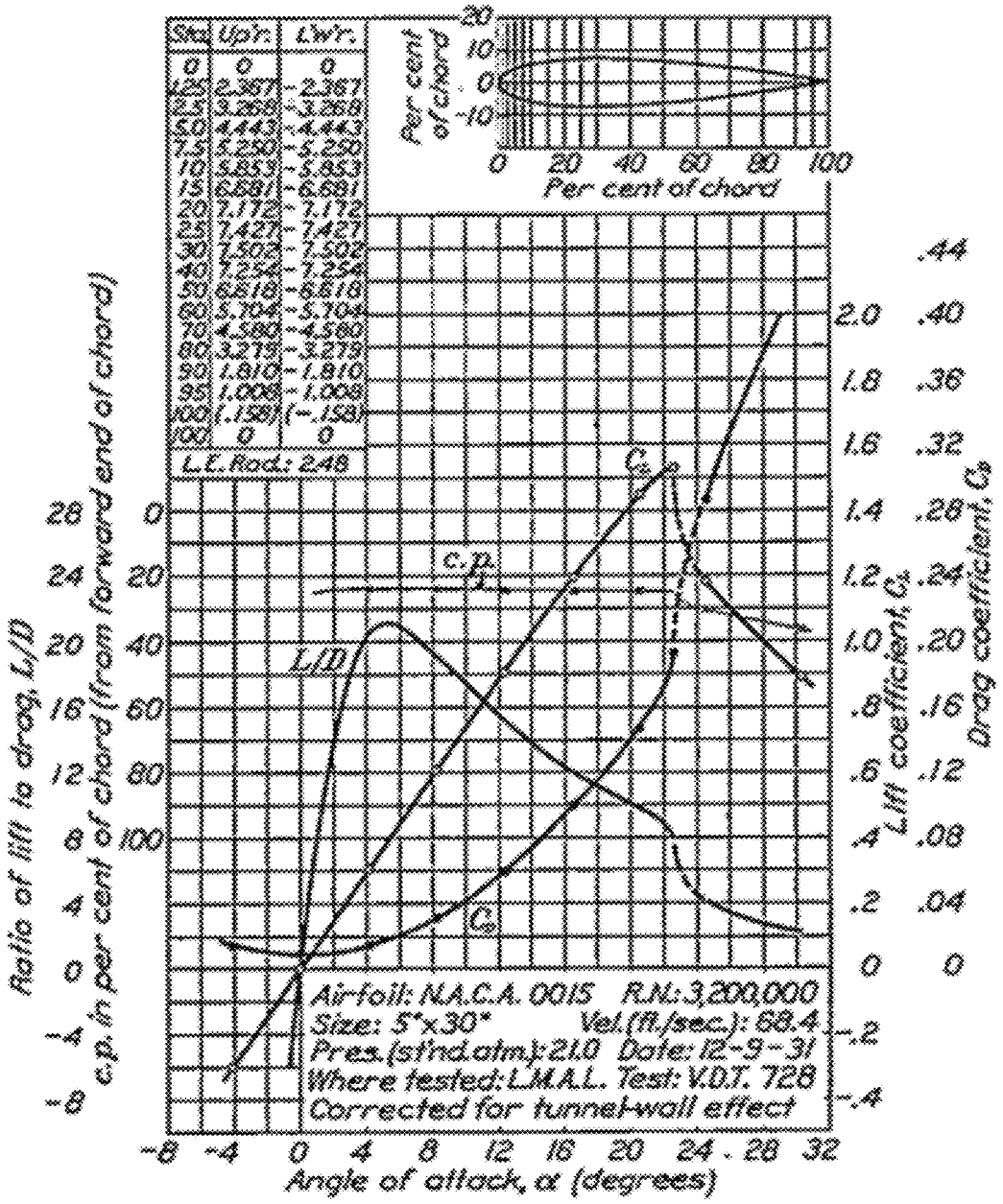
FIG. 21 shows a relation between an angle of attack and a lift/drag coefficient for a paravane in accordance with embodiments of the invention.

For the profile NACA 6712, the relation between the angle of attack and the lift/drag coefficient is as shown in FIG. 21.

To maximize lift while allowing for a certain movement of the paravane, without causing it to stall, the value of the angle of attack, and therefore $C_L$ and $C_D$ chosen can be as follows:

| | |
|---|---|
| α | 20 |
| $C_L$ | 1.6 |
| $C_D$ | 0.32 |

With α, $C_L$ and $C_D$ set, the remaining values can be determined through calculation as follows:

| PARAVANE NACA 6712 | | |
|---|---|---|
| cr | 1.80 | m |
| ct | 1.20 | m |
| Span | 2.30 | m |
| A | 3.45 | m^2 |
| alfa | 20.00 | deg |
| | 0.35 | rad |
| $C_L$ | 1.60 | |
| $C_D$ | 0.32 | |
| Lift offered | 1.85E+05 | N |
| Paravane Drag | 3.70E+04 | N |
| Drag To Win | 6.19E+04 | N |
| Lift Moment | 3.39E+06 | N*m |
| Drag Moment | 3.35E+06 | N*m |

Figure 22:
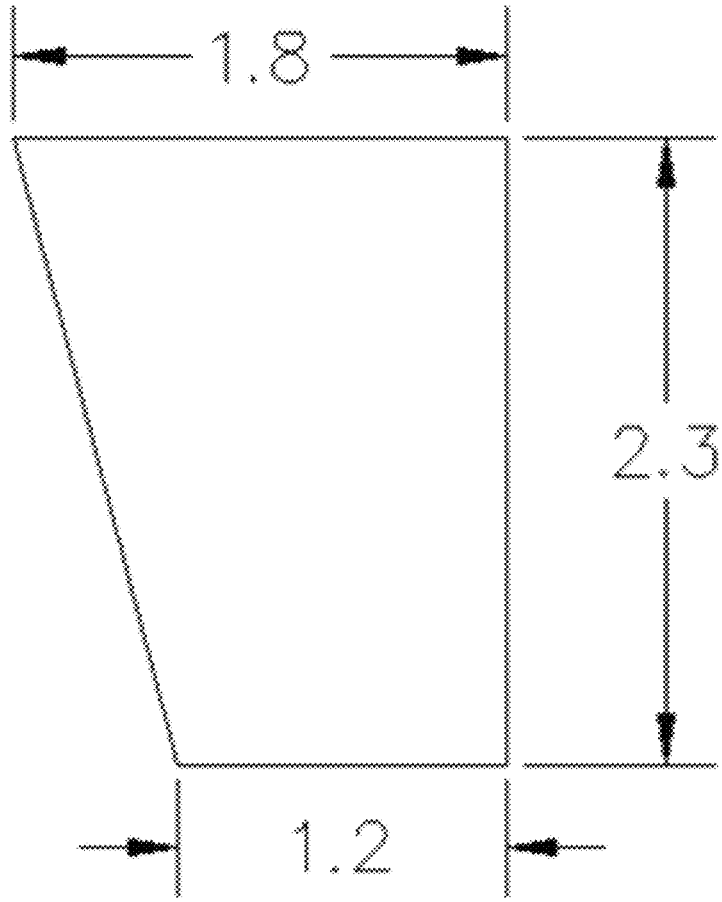
FIG. 22 shows a dimension of a paravane blade in accordance with embodiments of the invention.

The dimension of the paravane blade can therefore be as set forth in FIG. 22. Multiple blades can be used to reduce size.

Current naval architecture load requirements mean that lighter systems can be used. Accordingly, a light-weight tubular (even portable) construction can advantageously be used for the outriggers with the motors mounted inboard (to the main pivot point/mounting adjacent to the support) to further reduce overall weight. This can save considerable expense associated with stiffening and shipping. The weight of this equipment will not affect the vessel's cargo carrying capacity at all. Also, the light-weight tubular alloy construction can permit longer outriggers (the outriggers can be up to 20 m in length, for example) with minimum support strengthening. The tubular outrigger construction can also be easily fitted, and require only minimal under-deck reinforcement.

Required deck space is minimized by the inventive embodiments. The outriggers can stow in line and over the top of the vessel's existing railings.

Also, the drag effect is minimal (about 40 Kg per cartridge assuming deployment length of the full 3,000 feet). The maximum drag on the forward outriggers is expected to be about 160 Kg (assuming pattern density on 2.5 cm (1 inch) centers). The maximum moment on the forward outriggers (attributable to drag) is expected to be about 600 Kg/m. The drag is a product of the coefficient of friction in water and vessel speed and is not adversely affected by weather/sea state.

As an alternative to the above-described constructions, only main tendril lines with no secondary, tertiary or other offshoots can be used, and the spacing between lines can be closed (e.g., on 1 inch centers) or otherwise adjusted. In such case, it can be desirable to use intermediate spreaders along the length of the towed arrays. This can enhance recoverability and re-usability and reduce cost. The main long lines can be fitted with swivels to allow rotation.

Additionally, it is possible to exclude the aft outriggers and use only the transom mounted bank. It is also possible to use only shoulder outriggers, or to exclude the shoulder outriggers and use only the aft outriggers and/or transom bank.

Expediently, the deployment banks can hold reserve tendril lines. Also, a rendering device can be provided to manually or automatically play out additional tendril lines as needed in the event that lines are severed. The towed arrays can also be provided with an emergency release.

The outriggers can also be provided with fairing to prevent grappling hooks from hooking on thereto.

It should be appreciated that it is possible to provide embodiments of a watercraft immobilizing apparatus and system in accordance with the present invention that variously do not employ trailing end spreaders, or finned spreaders. It is even possible to substitute simple weight bars for submersible rollers, or to exclude the submersible rollers and simply deploy the tendril lines on the water surface.

It should be appreciated that the effectiveness of the watercraft immobilizing apparatus and system according to embodiments of the present invention can be increased by implementing vessel maneuvering practices when an attacking watercraft is detected. By way of example, when an attacking watercraft is in weapons range at the side or quarter of the protected vessel, the vessel can alter course towards the attacker and keep the helm hard over. This will effectively stall the towed side array on the attacker's side of the vessel. The vessel can complete a turn of approximately 270 degrees from its original heading to cross the trailing end of the stalled side array at approximately 90 degrees. If the attacking watercraft attempts to hold station on the vessel then it will be forced to cross the stalled side array.

Accordingly, the present invention provides embodiments of a marine vessel primary defense apparatus and system, the novel characteristics of which, including its optional continuous deployment, in conjunction with recommended maneuvering procedures, provide a non-lethal, passive, cost-effective means to prohibit attacking watercraft from closely approaching a protected vessel whilst it is underway.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A watercraft immobilizing apparatus deployable from a marine vessel, said apparatus comprising a plurality of separate entanglement lines configured to extend from and be towed by said vessel in surrounding water, said entanglement lines being configured to stream at least one of at and below the surface of said water about at least one assailable face of said vessel so as to become entangled in a propulsion system of an approaching watercraft.

2. The apparatus of claim 1, further comprising at least one cartridge configured to retain and administer said entanglement lines.

3. The apparatus of claim 2, wherein said at least one cartridge is replaceable.

4. The apparatus of claim 2, wherein said at least one cartridge is mountable on at least one outrigger of said vessel.

5. The apparatus of claim 4, further comprising at least one submersible dual roller structure suspended from said at least one outrigger configured to direct and maintain said entanglement lines generally parallel to said vessel at least one of at and below said water surface adjacent to said at least one cartridge.

6. The apparatus of claim 5, wherein at least one end of said dual roller structure includes a fin to prevent said entanglement lines from fouling a propeller of said marine vessel.

7. The apparatus of claim 2, further comprising at least one aft submersible dual roller structure suspended from the stern bulwark of said vessel to direct and maintain said entanglement lines at least one of at and below said water surface behind said vessel adjacent to said at least one cartridge.

8. The apparatus of claim 7, wherein said at least one aft submersible dual roller structure is expandable to cover the full transom of said vessel by segment extensions to said at least one cartridge.

9. The apparatus of claim 2, further comprising weighted spreader bars configured to hold each of said entanglement lines for each of said at least one cartridge in a submerged pattern.

10. The apparatus of claim 9, wherein said weighted spreader bars include fins for improved stability.

11. The apparatus of claim 9, wherein ones of said weighted spreader bars located at the stern of said vessel are attached to adjacent ones of said weighted spreader bars.

12. The apparatus of claim 1, wherein said entanglement lines are deployable at least one of along the port and starboard sides and behind the stern of said marine vessel.

13. The apparatus of claim 1, wherein said entanglement lines are weighted for neutral buoyancy.

14. The apparatus of claim 1, wherein said entanglement lines are formed from at least one of wire, nylon, and a biodegradable material.

15. The apparatus of claim 1, wherein individual ones of said entanglement lines include at least one further sub-line extending therefrom.

16. A watercraft immobilizing system for a marine vessel, said system comprising at least one outrigger positioned proximate at least one assailable face of said vessel; at least one cartridge mounted on said at least one outrigger; said at least one cartridge being configured to hold and to administer a plurality of lines; at least one submersible dual roller structure suspended below said at least one outrigger; said at least one roller structure being configured to receive and to direct said lines to stream adjacent to said at least one cartridge in a surrounding body of water at least one of at or below the surface of said water so as to become entangled in and foul a propulsion system of an approaching watercraft, said lines being constructed to break free of said vessel upon becoming entangled in said propulsion system.

17. The system of claim 16, further comprising at least one stern mounted cartridge and at least one aft submersible dual roller structure suspended from structure at said stern of said vessel to receive and to direct said lines from said at least one stern mounted cartridge to stream below said water surface behind said vessel.

18. The system of claim 17, wherein ones of said at least one submersible dual roller structure associated with ones of said at least one outrigger located at said stern of said vessel are connected to said at least one aft submersible dual roller structure to form a unit.

19. The system of claim 17, wherein said at least one aft submersible dual roller structure is expandable to cover the full transom of said vessel by means of segment extensions to said at least one stern mounted cartridge.

20. The system of claim 16, wherein ends of said at least one dual roller structure include fins to prevent said lines from fouling a propeller of said marine vessel.

21. The system of claim 16, wherein ends of each of said lines for said at least one cartridge are held in a submerged pattern by at least one weighted spreader bar.

22. The system of claim 16, wherein said at least one outrigger includes a pair of stern outriggers and a pair of forward outriggers; said forward outriggers including a port side outrigger and a starboard side outrigger; each of said stern and forward outriggers deploying said at least one cartridge and said at least one submersible dual roller structure.

23. The system of claim 16, wherein said lines are formed from at least one of wire, nylon, and a biodegradable material.

24. A vessel, comprising the watercraft immobilizing apparatus according to claim 1.

25. A vessel, comprising the watercraft immobilizing system according to claim 16.

26. The apparatus of claim 1, wherein secondary entanglement lines extend from said entanglement lines in intervals of not more than five feet.

27. A method for immobilizing a watercraft comprising the step of deploying the watercraft immobilizing apparatus as claimed in claim 1.

28. A watercraft immobilizing system for a marine vessel, said system comprising a first mounting unit positioned proximate at least one assailable face of said vessel and coupled to a floating apparatus via at least one transverse link; and a second mounting unit positioned proximate at least one of a forward portion and an aft portion of said vessel, said second mounting unit coupled to said floating apparatus via at least one boom, said at least one boom coupled to a plurality of separate entanglement lines to direct said entanglement lines to stream at least one of at and below the surface of the surrounding water so as to become entangled in a propulsion system of an approaching watercraft.

29. The system of claim 28, wherein said floating apparatus is a floated paravane.

30. The system of claim 29, wherein said paravane includes at least one fin.

31. The system of claim 28, wherein said at least one transverse link is configured to couple said first mounting unit to said floating apparatus via a bridle.

32. The system of claim 28, wherein said at least one boom is at least one of a wire and a chain.

33. The system of claim 28, wherein said at least one boom includes eyes for coupling to said entanglement lines.

34. The system of claim 28, wherein said at least one boom supports at least one storage roller for directing said entanglement lines.

35. The system of claim 28, wherein said at least one boom is coupled to said vessel via at least one of a traveling block of said vessel, a folding bowsprit of said vessel, and a hard connection to the hull of said vessel.

36. A vessel, comprising the watercraft immobilizing system according to claim 28.

37. A marine vessel defense system, comprising the watercraft immobilizing apparatus of claim 1.

38. A marine piracy prevention system, comprising separate entanglement lines attached to sides of a first marine vessel, said lines being storable and deployable via at least one boom, said lines being configured to foul a propulsion system of a second marine vessel when said lines are deployed in water about both said first marine vessel and said second marine vessel.

39. The watercraft immobilizing apparatus of claim 1, wherein said separate entanglement lines are configured to break free of said vessel upon becoming entangled in said propulsion system.

40. The watercraft immobilizing apparatus of claim 1, wherein said separate entanglement lines are deployable from at least one outrigger of said vessel.

* * * * *